US005638158A

United States Patent [19]

Sanpe et al.

[11] Patent Number: 5,638,158

[45] Date of Patent: Jun. 10, 1997

[54] IMAGE FORMATION APPARATUS

[75] Inventors: Atsushi Sanpe, Yokohama; Hirohisa Otsuka, Kawaguchi; Kazuhisa Sudo, Tokyo, all of Japan

[73] Assignee: Ricoh Company, Ltd., Tokyo, Japan

[21] Appl. No.: 403,954

[22] Filed: Mar. 14, 1995

[30] Foreign Application Priority Data

| | | | |
|---|---|---|---|
| Mar. 14, 1994 | [JP] | Japan | 6-042611 |
| Jul. 8, 1994 | [JP] | Japan | 6-157241 |
| Oct. 31, 1994 | [JP] | Japan | 6-267591 |

[51] Int. Cl.[6] ..... G03G 15/02

[52] U.S. Cl. ..... 394/174; 361/225; 361/230; 361/214; 399/115; 399/100; 399/167

[58] Field of Search ..... 355/219, 200, 355/210; 361/225, 230, 214

[56] References Cited

U.S. PATENT DOCUMENTS

| | | | |
|---|---|---|---|
| 4,371,252 | 2/1983 | Ushida et al. | 361/225 X |
| 5,095,335 | 3/1992 | Watanabe et al. | 355/219 X |
| 5,367,364 | 11/1994 | Michlin et al. | 355/219 |
| 5,386,274 | 1/1995 | Sanpe et al. | 355/215 |
| 5,390,007 | 2/1995 | Kugoh et al. | 355/219 |
| 5,465,136 | 11/1995 | Watanabe | 355/219 X |
| 5,475,472 | 12/1995 | Saito et al. | 355/219 |

FOREIGN PATENT DOCUMENTS

| | | |
|---|---|---|
| 3-126979 | 5/1991 | Japan . |
| 3-269443 | 12/1991 | Japan . |
| 4-76569 | 3/1992 | Japan . |
| 4-157485 | 5/1992 | Japan . |
| 4-278961 | 10/1992 | Japan . |
| 5-53413 | 3/1993 | Japan . |

*Primary Examiner*—Matthew S. Smith

*Attorney, Agent, or Firm*—Oblon, Spivak, McClelland, Maier & Neustadt, P.C.

[57] ABSTRACT

At least a photosensitive drum 2 and charge roller 9 are attached to a unit 8 so that the photosensitive drum 2 and charge roller 9 can be freely attached to and detached from an apparatus body 1 in unison with the unit case 8, and the charge roller 9 can be freely brought into and out of contact with the surface of the photosensitive drum 2. The apparatus body 1 is provided with pressure cams 5*a* and 5*b* adapted to cause the charge roller 9 to be brought into and out of contact with the surface of the photosensitive drum 2.

11 Claims, 13 Drawing Sheets

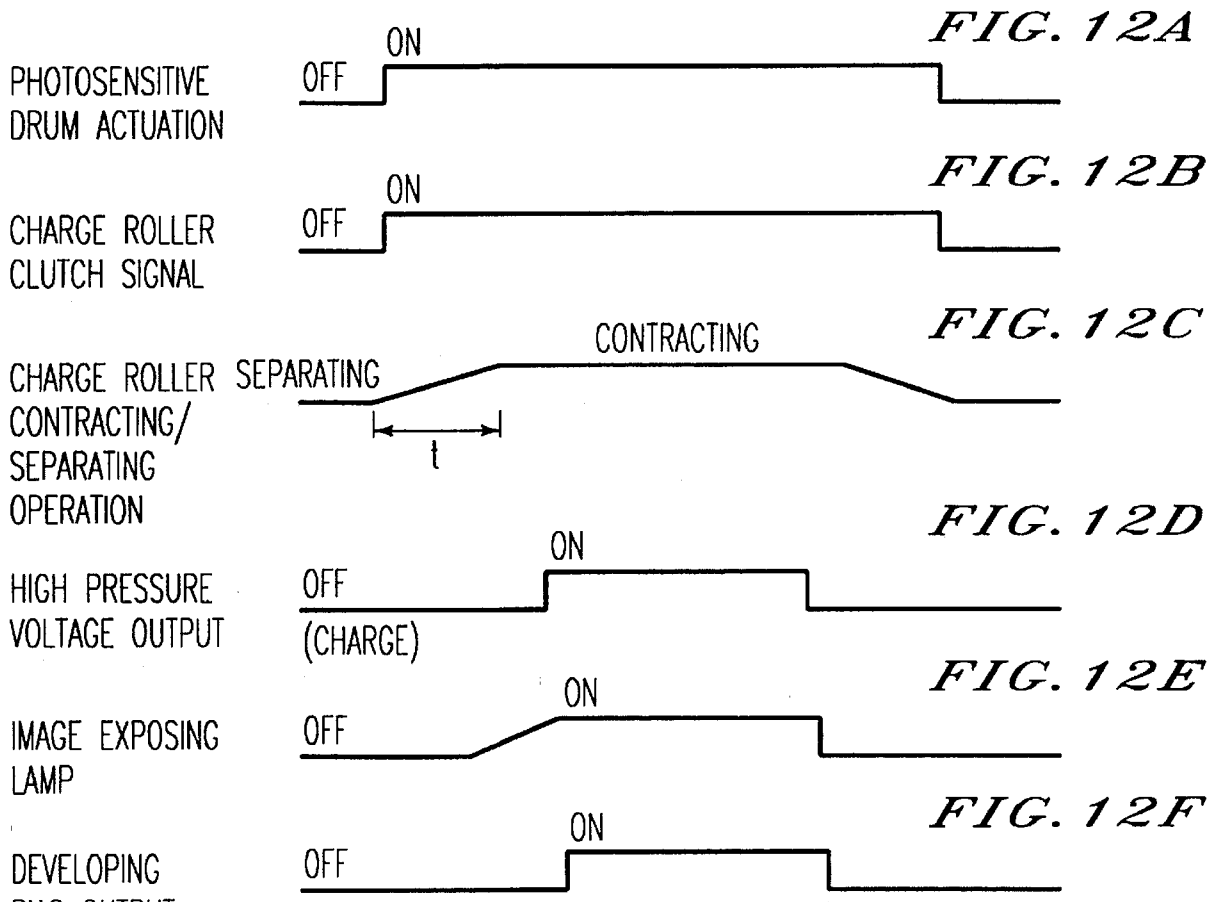
FIG. 12A
PHOTOSENSITIVE DRUM ACTUATION
ON
OFF
FIG. 12B
CHARGE ROLLER CLUTCH SIGNAL
ON
OFF
FIG. 12C
CHARGE ROLLER CONTRACTING/ SEPARATING OPERATION
CONTRACTING
SEPARATING
t
FIG. 12D
HIGH PRESSURE VOLTAGE OUTPUT
ON
OFF
(CHARGE)
FIG. 12E
IMAGE EXPOSING LAMP
ON
OFF
FIG. 12F
DEVELOPING BIAS OUTPUT
ON
OFF
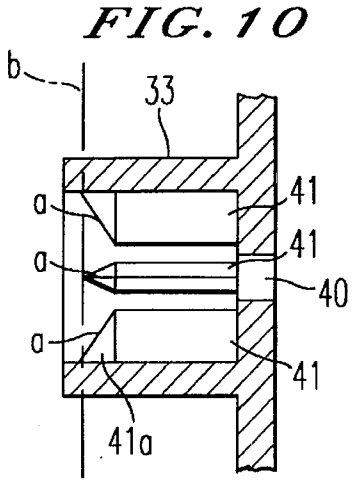
FIG. 10
33
41
41
40
41
41a
a
a
a
b
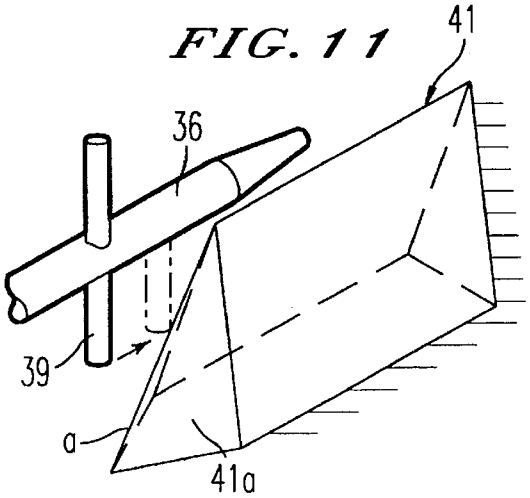
FIG. 11
41
36
41a
a
39

IMAGE FORMATION APPARATUS

BACKGROUND OF THE INVENTION

1. Field of the Invention

This invention relates to an electrophotographic type image formation apparatus such as an electrophotographic copying machine, a laser printer, a laser facsimile, an electrostatic recorder and the like.

More particularly, it relates to an image formation apparatus for forming an image (or picture) through an image formation process including the step of charging the surface of an image carrier such as an electrophotographic sensitive body and an electrostatic recording dielectric.

2. Description of the Prior Art

Recently, a conventional image formation apparatus such as an electrophotographic copying machine, which employs an electrophotographic system, includes a contact-to-charge means such as a charge roller, for the purposes of achieving a low ozone emission and a power saving.

The contact-to-charge means is operated to contact under a predetermined pressure the surface of an image carrier in order to charge the surface. For example, the charge roller, which is held in contact with the surface of the image carrier, is rotated together with the image carrier to uniformly charge the surface of the image carrier with an electric potential.

Of all the image formation apparatus of this type, there is one which is of a unit construction, having a process cartridge removably mounted on the main body of the apparatus and adapted to contain an image carrier and attachments thereof, chiefly for the purpose of achieving an easy maintenance.

In an image formation apparatus disclosed in Japanese Laid-Open Patent Publication No. Hei 3-130787, a charge roller serving as a contact-to-charge means is located on the apparatus body such that when a process cartridge is attached to the apparatus body, the charge roller is faced with the surface of the image carrier.

Also, with respect to the contact-to-charge type image formation apparatus, various proposals (invention) are heretofore made in order to prevent inferior charge.

For example, Japanese Laid-Open Patent Publication Nos. Hei 53-130787 and Hei 5-188738 disclose inventions in which a cleaning member is brought into and out of contact with the surface of a charge roller to remove foreign matters attached to the surface of the charge roller so that a uniform charging is realized.

On the other hand, in the event that a remaining toner is adhered to the surface of the carrier itself, there is a possibility that the remaining toner adheres also to the charge roller to thereby invite inferior charge.

In view of the above, there is heretofore known a type in which a carrier cleaning means, such as a cleaning blade, is brought into contact with the surface of the image carrier in order to remove the remaining toner on the surface of the image carrier on the upstream side of the charge roller by this carrier cleaning means.

As one example of this type, there is known an arrangement in which a cleaning blade is located on the upstream side of the contact area of a charge roller, so that the cleaning blade is brought into contact under a predetermined pressure with the image carrier to scrape off the remaining toner on the surface of the image carrier with the edge of the cleaning blade.

SUMMARY OF THE INVENTION

Generally speaking, the charge roller (contact-to-charge means) must be arranged in parallel relation to the image carrier because, if not, the roller cannot contact the image carrier under a uniform pressure. If the charge roller contacts the image carrier under a non-uniform pressure, the electric potential of charge of the image carrier also becomes non-uniform and as a result, an image irregularity is produced.

With respect to the above-introduced image formation apparatus having a unit construction, it has on the one hand such an advantage that maintenance of the image carrier is easy but it has on the other hand such a disadvantage that since the contact-to-charge means is not located on the apparatus body, it is difficult to arrange the contact-to-charge means in parallel relation to the image carrier, in other words, it is difficult to correctly locate the image carrier with respect to the contact-to-charge means.

Since a rotational driving source for rotating the image carrier is provided on the apparatus body, the image carrier is connected to the rotational driving source when the process cartridge is attached to the apparatus body. In general, a power transmission means comprising a coupling mechanism and a gear assembly is employed in order to achieve this power transmission. However, in any of the power transmission means, there is a possibility that teeth engaging position is displaced when the coupling and gears are engaged. In order to correct this displacement of the teeth engaging position, a very small amount of relative rotation is required within a connection mechanism when the process cartridge is attached to the apparatus body. In order to facilitate a smooth engagement, a member such as a cleaning blade, which is to be brought into contact with the image carrier, is kept spaced away from the image carrier until the process cartridge itself is attached to the apparatus body.

Also, there is known another image formation apparatus in which the cleaning blade is kept spaced away from the image carrier during the time the image carrier is not in operation and the cleaning blade is brought into contact with the image carrier only during the time the image carrier is in operation, in order to maintain the cleaning performance or ability for a long time by restraining aging deformation and fatigue of the cleaning blade.

In the systems as mentioned above, there is such a fear that when the cleaning blade once spaced away from the image carrier is brought into contact with the image carrier again, even a very small amount of rotation of the image carrier made during that time can cause a pool of foreign matters such as toner and paper powder which has been dammed up with the edge of the cleaning blade till that time to flow so far as to the downstream side of the rotating direction, i.e., so far as to the contact area of the charge roller.

Once the pool of foreign matters is adhered to the charge roller, it is difficult to remove such a large amount of foreign matters with the cleaning member of the charge roller and the cleaning member is clogged to decrease its ability to remove the foreign matters. As a consequence, since the foreign matters are kept adhered to the charge roller, the electric potential of charge becomes partly irregular, thereby making it difficult to form a clear image.

The present invention is worked out with the above mentioned situation as its background. It is, therefore, an object of the present invention to provide an image formation apparatus of the contact-to-charge type, having a unit construction, in which accuracy of positioning of an image carrier with respect to a contact-to-charge means can be improved, the contact-to-charge means can be brought into contact with the image carrier under a stable pressure, and the contact-to-charge means can be maintained in its clean state, thereby forming an image of high quality for a long time.

By arranging the unit case to which the image carrier and contact-to-charge means are integrally attached such that the unit case can be freely attached to and detached from the apparatus body, accuracy of positioning between the image carrier and the contact-to-charge means can be maintained for a long time without being adversely affected by rattling invited between the apparatus body and the unit case. Consequently, the surface of the image carrier can be uniformly charged.

Also, by enabling to cause the contact-to-charge means to be separated or spaced away from the image carrier, the contact-to-charge means can be kept spaced away from the surface of the image carrier during the time the image carrier is stopped in rotation, for example. As a consequence, there can be prevented the image carrier from being deteriorated due to fatigue of the contact-to-charge means and exudation of hazardous substances (for example, plasticizer contained in electrically-conductive rubber) from the contact-to-charge means.

In the event that the contact-to-charge means is normally biased by a biasing means (represented by A here) in a direction away from the image carrier, another biasing means B is required in order to cause the contact-to-charge means to be brought into contact with the image carrier. At that time, magnitude of a contact pressure of the contact-to-charge means with respect to the image carrier is equal to a value obtained by subtracting the biasing force of the biasing means A from the biasing force of the biasing means B. Difficulties are encountered to control the contact pressure of the contact-to-charge means with respect to the image carrier to a constant value by adjusting biasing forces of a plurality of biasing means as mentioned.

Therefore, according to the invention, the contact-to-charge means is normally biased in a contacting direction with the image carrier. Owing to the foregoing arrangement, magnitude of the contact pressure of the contact-to-charge means with respect to the image carrier can be easily controlled to a constant value merely by adjusting the biasing means of a single biasing means.

Also, by installing the biasing means as the image carrier and contact-to-charge means within the unit case, relative positioning of those members can be easily made. In addition, there is no fear that positional displacement occurs even if those members are repeatedly attached to and detached from the apparatus body. Consequently, the contact-to-charge means can be brought into contact with the image carrier for a long time by a uniform stable pressure, thus enabling to realize a uniform charge.

The separating/contacting means is a means for causing the contact-to-charge means to be brought into and out of contact with the surface of the image carrier as mentioned. By providing this separating/contacting means on the apparatus body, the driving mechanism required for the operation for contacting/separating the contact-to-charge means can be installed on the apparatus body. Consequently, the construction of the unit case can be simplified, thus enabling to enhance its easy attachment and detachment.

Also, the angle formed between the adjacent normals passing across the areas (contact areas) where the carrier cleaning means and contact-to-charge means contact the image carrier is equal to an angle of rotation which occurs when the foreign matters on the contact area of the carrier cleaning means on the image carrier are moved to the contact area of the contact-to-charge means.

If the carrier is attached to the apparatus body while separating the carrier cleaning means from the image carrier, the image carrier is very slightly rotated when it is connected to the driving rotary shaft. As a consequence, it sometimes occurs that foreign matters, such as remaining toner dammed up by the carrier cleaning means, are moved around toward the downstream side of the contact area of the carrier cleaning means. Thereafter, if the contact-to-charge means is brought into contact with the image carrier at the same time the image carrier starts, the foreign matters adhere directly to the contact-to-charge means.

In view of the above, according to the invention, the contact-to-charge means is kept spaced away from the image carrier until the foreign matters moved around to the downstream side of the contact area of the carrier cleaning means actually exceeds the contact area of the contact-to-charge means, namely, until the angle of rotation of the image carrier exceeds the angle formed between the adjacent normals passing across the areas (contact areas) where the carrier cleaning means and contact-to-charge means contact the photosensitive drum.

Those foreign matters, which have exceeded the contact area of the contact-to-charge means, are scraped off by a magnetic brush or a developing device, etc. which are located on the downstream side thereof, or scraped off again by the carrier cleaning means, so that they are removed from the surface of the image carrier.

Furthermore, the present invention may include a construction in which the unit case is provided with a charge cleaning means for cleaning the contact-to-charge means, such that when the contact-to-charge member is kept spaced away from the image carrier, this contact-to-charge member is cleaned by being brought into contact with a charge member cleaning means.

Owing to this construction, the foreign matters can be effectively removed from the contact-to-charge means and the contact-to-charge means can be always maintained in a clean state.

Also, depending on a connection mechanism between the rotational driving shaft and the image carrier provided on the apparatus body, there is a fear that the foreign matters at the connecting area of the carrier cleaning means on the image carrier is greatly rotated beyond the connecting area of the contact-to-charge means when the rotational driving shaft and the image carrier are connected to each other. At that time, if the contact-to-charge means is spaced away from the image carrier, there is no problem. However, if the contact-to-charge means is in contact with the image carrier, the foreign matters dammed up by the carrier cleaning means are moved to the contact area of the contact-to-charge means and adhered to the contact-to-charge means.

In view of the above, according to the invention, by setting the maximum relative angle of rotation between the follower element formed on the mounting sleeve portion of the image carrier and the drive transmission pin disposed on the rotational driving shaft, i.e., the angle of rotation of the image carrier when it is connected, smaller than the angle of rotation which occurs when the foreign matters at the connecting area of the carrier cleaning means on the image carrier are moved to the contact area of the contact-to-charge means, adhesion of the foreign matters to the contact-to-charge means is prevented.

Specifically, the apparatus body includes a rotational driving shaft for rotationally driving the image carrier, and a drive transmission pin disposed on the rotational driving shaft and extending radially. The image carrier includes a sleeve-like coupling portion formed on one end of the image carrier, a plurality of follower elements extending radially from an inner wall of the coupling portion at a predetermined angle, and an insertion portion formed between the follower elements. Further, an end portion on the side of an opening portion of the coupling portion in the follower elements is formed by a single or a plurality of inclination surfaces inclining toward the insertion portion side of the drive transmission pin. A maximum relative angle of rotation formed between the follower element and the drive transmission pin when the drive transmission pin is brought into contact with the inclination surfaces and received in the insertion portion, is set smaller than the angle formed between the adjacent normals passing across the areas (contact areas) where the carrier cleaning means and contact-to-charge means contact the image carrier.

Here, it is preferred that a ridge line at a crest portion of the inclination surfaces forming the end portion of the follower elements is situated in an imaginary plane which is generally perpendicular to the insertion direction of the drive transmission pin. Owing to this arrangement, even if it happens that the rotational drive transmission pin contacts the ridge line forming the crest portion of the inclination surfaces in the follower elements when the rotational driving shaft and the image carrier are connected to each other, the follower elements can be prevented from being damaged because the rotational drive transmission pin contacts the ridge line in a line-contact fashion and therefore, the contact shock or impact is dispersed.

BRIEF DESCRIPTION OF THE DRAWINGS

FIG. 10 is a perspective view for explaining the operation of the follower element in comparison with FIG. 4;

FIG. 11 is a perspective view for explaining the operation of the follower element in comparison with FIG. 9;

FIG. 12 is a timing chart showing the contact timing of the charge roller in the image formation apparatus of FIG. 1;

DETAILED DESCRIPTION OF THE PREFERRED EMBODIMENT

The present invention will now be described with reference to some preferred embodiments in which the present invention is applied to an electrophotographic copying machine.

Figure 1:
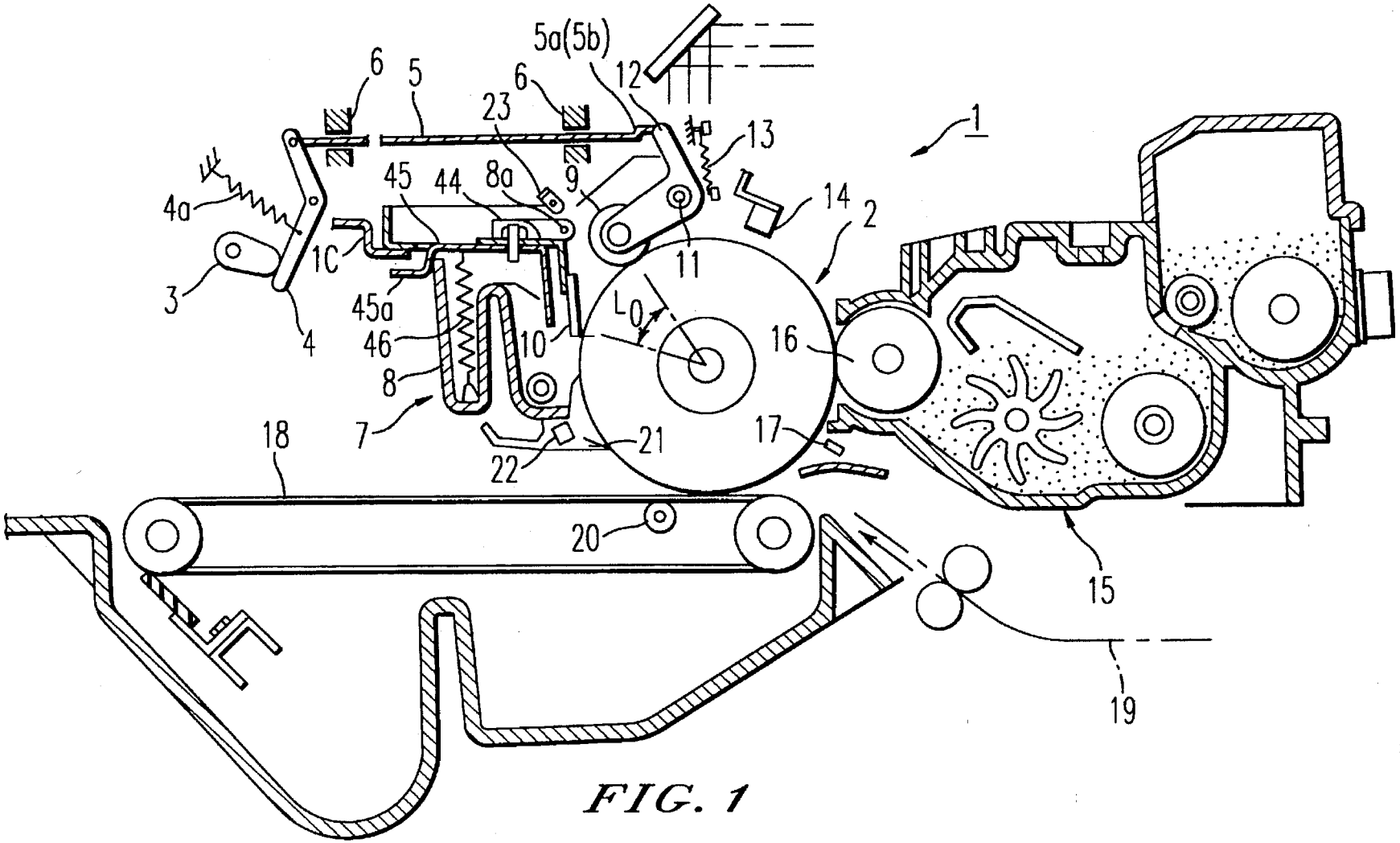
FIG. 1 is a front sectional view showing a diagrammatic construction of an image formation apparatus according to a first embodiment of the present invention.

FIG. 1 is a sectional front view showing a diagrammatic construction of an image formation apparatus according to a first embodiment of the present invention.

Reference numeral 1 denotes a main body of the image formation apparatus (hereinafter, this main body is referred to as the "apparatus body" or "body"). In this apparatus body 1, when a main switch is turned on and then a control button on a control panel is turned on, a photosensitive drum 2 as an image carrier is rotated clockwise as viewed in FIG. 1. Almost at the same time, a control signal is input from a control unit to a semi-rotating clutch, not shown. As a consequence, a cam 3 is turned 180 degrees to turn a cam lever 4 counterclockwise as viewed in FIG. 1 about a support shaft. The cam lever 4 is biased clockwise as viewed in FIG. 1 by a coil spring 4*a*. The cam lever 4 is connected to one side of a flat slider 5 (see FIG. 2). This slider 5 is mounted such that it can move rightwardly and leftwardly as viewed in FIG. 1 by a guide 6 formed on the apparatus body 1. The slider 5 is moved leftwardly as viewed in FIG. 1, as the cam lever 4 is turned counterclockwise as viewed in FIG. 1.

Reference numeral 7 denotes a charge portion unit. This charge portion unit 7 includes the photosensitive drum 2, a charge roller 9 as a contact-to-charge means, a cleaning blade 10, etc., all of which are received in a unit case. Those component members can be attached to and detached from the apparatus body 1 by unit.

Figure 2:
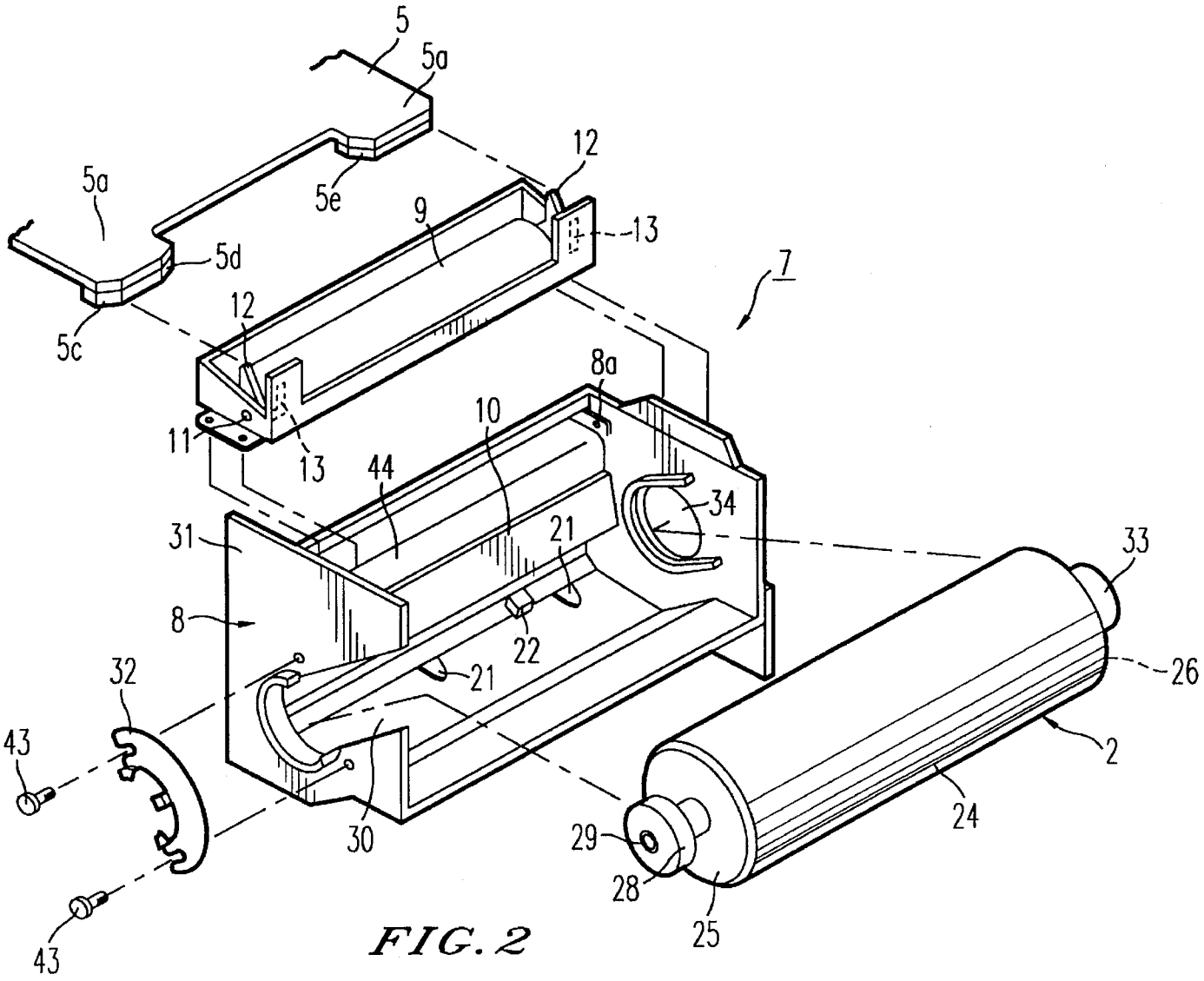
FIG. 2 is an exploded perspective view showing a charge portion unit of the image formation apparatus of FIG. 1.

FIG. 2 is an exploded perspective view of the charge portion unit 7. This charge portion unit 7 will be described in more detail later.

As shown in FIG. 2, opposite end portions of the charge roller 9 are supported by a pair of turning levers 12 and 12 which can be turned about a support shaft 11. As the turning levers 12 and 12 are turned, the charge roller 9 is brought into and out of contact with the photosensitive drum 2. Each of the pair of turning levers 12 and 12 supports the charge roller 9 independently. The turning levers 12 and 12 are biased in a contacting direction (counterclockwise as viewed in FIG. 2) with the photosensitive drum 2 respectively by coil springs 13 and 13 which are served as biasing means.

Pressing cams 5*a* and 5*b* are provided respectively on opposite corner portions of the other side of the slider 5. During the time the apparatus is not in operation, the pressing cams 5*a* and 5*b* are brought into contact respectively with the turning levers 12 and 12 to turn the levers clockwise as viewed in FIG. 2. As a consequence, the charge roller 9 are separated or spaced away from the photosensitive drum 2. Then, as the slider 5 is moved leftwardly as viewed in FIG. 2, the turning levers 12 and 12 are turned counterclockwise as viewed in FIG. 2. As a consequence, the charge roller 9 is brought into contact with the surface of the photosensitive drum 2 under the effect of the coil springs 13.

In this embodiment, the cam 3 and its driving source, the cam lever 4, the slider 5, the pressing cams 5*a*, 5*b*, etc., all provided on the apparatus body 1, constitute the contacting/separating means for causing the charge roller 9 to be brought into and out of contact with the photosensitive drum 2.

Then, a high voltage is supplied to the charge roller 9 and a minus electric charge is uniformly applied to the surface of the rotating photosensitive drum 2.

A copy set to a scanner portion, not shown, is read by a scanner which is integral with a light source (halogen lamp or the like), and an image of the copy thus read is projected on the surface of the photosensitive drum 2 through a plurality of mirrors. The minus electric charge on the photosensitive drum 2 is reduced in accordance with the intensity of the projected light at that time, and an electrostatic latent image is formed on the photosensitive drum 2.

Subsequently, electrical potential of charge at that area where the electrostatic latent image is not formed, is removed by an eraser 14 and toner is adhered to the electrostatic image latent image on the photosensitive drum 2 by a developing device 15. As a result, a visible image is formed on the photosensitive drum 2. This visual image is formed through the process in which a lower minus bias voltage than the electric potential is supplied to a developing sleeve 16 provided on the developing device 15 and plus charged-toner due to agitation of a developing carrier is adhered to the latent image on the photosensitive drum 2 by a magnetic brush.

Thereafter, in order to improve the transfer efficiency of the photosensitive drum 2, the electric potential on the surface is lowered by exposing the overall surface of the photosensitive drum 2 before transfer by a pre-transfer antistatic lamp (PTL) 17.

A transfer paper 19 is supplied to an electrically-conductive belt 18 in synchronism with the rotation of the photosensitive drum 2. Since a high voltage has been supplied to the electrically-conductive belt 18 by a bias roller 20, the supplied transfer paper 19 is electrostatically intimately attached to the surface of the electrically-conductive belt 18. Then, the bias roller 20 is pressed against the photosensitive drum 2 by a solenoid, not shown, and a minus electric charge is supplied from the back of the transfer paper 19 intimately attached to the electrically-conductive belt 18 so that the plus toner on the photosensitive drum 2 is transferred to the transfer paper 19. Reference numeral 21 denotes a separation claw for positively separating the post-transfer paper 19.

A P-sensor 22 reads image density of a predetermined pattern (P-sensor pattern) developed on the photosensitive drum 2 by a photosensor and turns on/off a toner replenishing clutch, not shown, depending on the image density, to thereby adjust the toner density.

After the completion of transfer, the remaining toner on the photosensitive drum 2 is scratched off by the cleaning blade 10 and fed again into a hopper of the developing device 15 for reuse.

Lastly, in order to erase the electric charge remained on the photosensitive drum 2, the overall surface is exposed by an antistatic lamp 23 so as to be made ready for the next copy.

In the apparatus of this embodiment, the charge portion unit 7 includes such component members as the photosensitive drum 2, the charge roller 9, the cleaning blade 10, the P-sensor 22, the separation claw 21, etc., all disposed within the unit case 8, as shown in FIG. 2.

Figure 3:
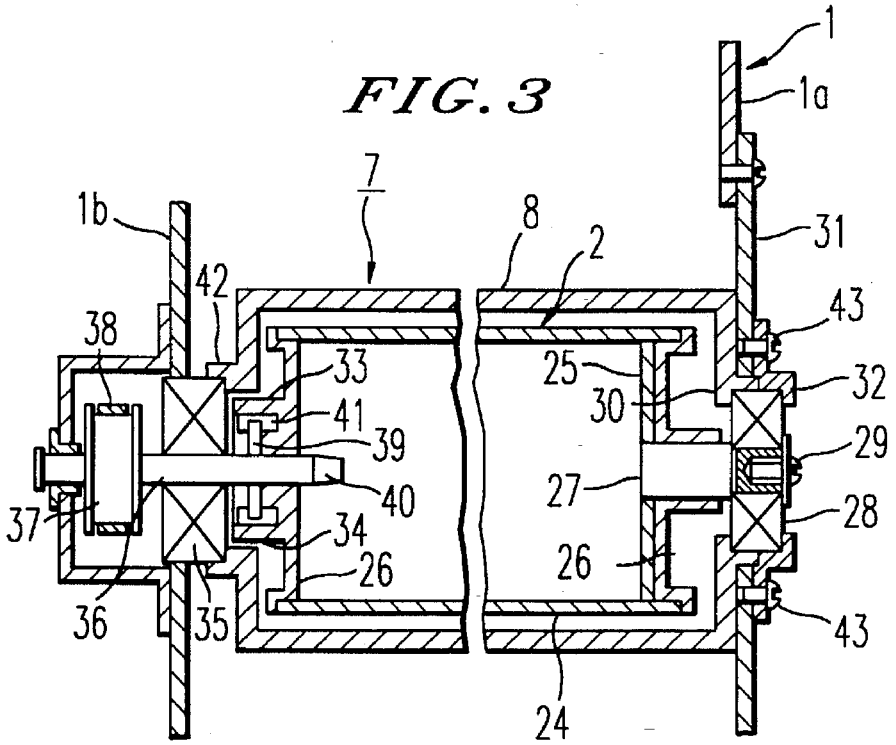
FIG. 3 is a center-side sectional view showing the charge portion unit and its nearby area of the image formation apparatus of FIG. 1.

FIG. 3 is a center-side sectional view of the charge portion unit 7 and its nearby area. In FIG. 3, the right-hand side corresponds to this side of the apparatus body 1 and maintenance of the apparatus is usually started from this side.

The photosensitive drum 2 includes an electrically-conductive sleeve member 24. Electrically insulative support disks 25 and 26 are fitted in opposite end portions of the sleeve 24, respectively. A shaft fit portion protruding outwardly is formed on a central portion of the support disk 25 located on this side of the apparatus body 1. A support shaft 27 is fitted into the shaft fit portion. The support shaft 27 is electrically contacted with the photosensitive drum 2 through a disk-like electrically-conductive plate 25*a*, and an inner wheel of a ball bearing 28 is attached to an outer distal end portion of the support shaft 27 by a screw 29.

The ball bearing 28 is fixedly fitted at its outer wheel into a U-shaped cut-out portion 30 formed in a side wall plate 31 on this side of the unit case 8, as shown in FIG. 2.

Reference numeral 32 denotes a fixing member for securing the ball bearing 28 to the unit case 8. The fixing member 32 is fitted into the ball bearing 28 under a small pressure and secured to the side wall plate 31 by screws 43, 43.

According to this construction, by fitting the ball bearing 28 into the cut-out portion 30, this side of the photosensitive drum 2 can be correctly positioned with respect to the unit case 8.

The side wall plate 31 is secured to a front side plate 1*a* located on this side of the apparatus body 1 by a screw, thereby this side of the unit case 8 can be positioned with respect to the apparatus body 1.

Any one of the ball bearing 28, fixing member 32, side wall plate 31 and front side plate 1*a* is formed of an electrically-conductive material, and the photosensitive drum 2 is grounded through those members.

On the other hand, a mounting sleeve portion 33 projecting outwardly is formed on a central portion of the support disk 26 located on that side of the apparatus body 1. This mounting sleeve portion 33 is loosely fitted into a support hole 34 formed in the side wall plate located on that side of the unit case 8. As a consequence, a clearance of a certain range is provided between the mounting sleeve portion 33 and the supporting hole 34.

The size of this clearance is appropriately determined depending on that of the mounting sleeve portion 33. If it is too small, there occurs a problem in that when the photosensitive drum 2 is rotated, the mounting sleeve portion 33 is brought into contact only at its one side with the inner peripheral surface of the support hole 34 due to eccentricity between the unit case 8 and the photosensitive drum 2. On the contrary, if the clearance is too large, there occurs another problem in that when the charge portion unit 7 is removed from the apparatus body 1, the ball bearing 28 is damaged because the photosensitive drum 2 is supported only by the ball bearing 28 on this side.

Incidentally, according to our test, a favorable result was obtained when the size of the clearance between the mounting sleeve portion 33 and the supporting hole 34 was set to 0.51 mm to 0.8 mm in the case where the outer diameter of the mounting sleeve portion 33 is 24 mm.

Figure 9:
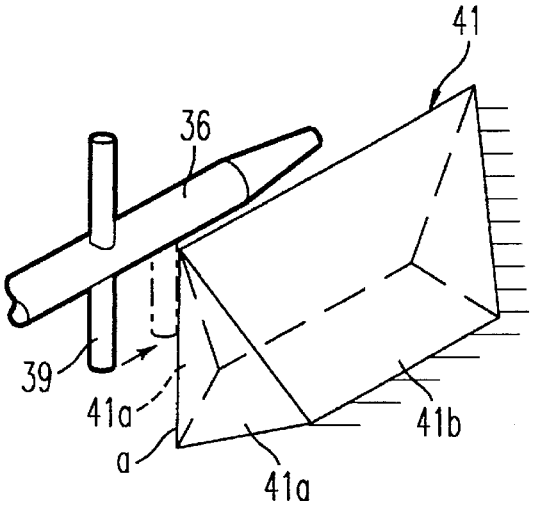
FIG. 9 is a perspective view showing how the drive transmission pin hits or contacts the follower element.

A ball bearing 35, which is coaxial with the ball bearing 28, is mounted on a rear side plate **1*b* located on that side of the apparatus body 1. This ball bearing 35 includes a rotational driving shaft 36. A pulley 37 is attached to an outer end portion of the rotational driving shaft 36. A belt 38 is disposed between the pulley 37 and a driving source not shown. A drive transmission shaft 39 is mounted on the rotational driving shaft 36 such that the shaft 39 is allowed to pierce radially into the shaft 36 at its area situated inwardly of the ball bearing 35 (see FIGS. 9 and 11**).

On the other hand, a positioning hole 40 for receiving the rotational driving shaft 36 is formed in a central area of the mounting sleeve portion 33 of the photosensitive drum 2. A plurality of follower elements (or driven elements) 41 are radially formed on an inner peripheral wall of the mounting sleeve portion 33 at predetermined spaces (see FIG. 5). Into a space formed between adjacent follower elements 41, the drive transmission pin 39 is inserted so that the driven elements and the drive transmission pin 39 are engaged with each other.

Also, a bearing portion 42 is formed on an outer peripheral edge portion of the support hole 34 formed in the side wall on that side of the unit case 8. An outer wheel of the ball bearing 35 is fitted to the bearing portion 42, and a portion on that side of the unit case 8 can be fixedly located on a rear side plate **1*b* of the apparatus body 1**.

In the conventional electrophotographic copying machine having a charge portion of a unit construction, bearings are firmly attached respectively to opposite ends of the unit case, so that opposite ends of the photosensitive drum are correctly positioned and axially supported by those bearings. Each bearing is firmly secured to the unit case using a fixing member comprising a fixture plate and a fixture member. Consequently, when the photosensitive drum is removed from the unit case, it is required that tightening state of the fixing member is released at opposite ends of the unit case and the bearings are then removed from the unit case. Therefore, workability of maintenance, etc. is not good.

In contrast, with respect to the charge portion unit 7 of this embodiment, the unit case 8 and the photosensitive drum 2 can be easily attached and detached. Specifically, as shown in FIG. 2, the screws 43, 43 for securing the fixing member 32 are untightened to release the ball bearing 28 from its fixed position. Then, the photosensitive drum 2 is slightly axially moved this way to retrieve the mounting sleeve portion 33 from the support hole 34. At the same time, the ball bearing 28 is pulled slant-wise upwardly along the cut-out portion 30. By doing this, the photosensitive drum 2 can be removed from the unit case 8. It should be noted that the photosensitive drum 2 can be mounted on the unit case 8 in the reverse way.

Next, the cleaning blade 10 as a carrier cleaning means will be described. As shown in FIG. 1, the cleaning blade 10 is attached to a holder 44, and the holder 44 is secured to a bracket 45 as a cleaning contacting/separating means by screws.

The bracket 45 is turnably supported by a support shaft **8*a* disposed at the unit case 8 and biased counterclockwise as viewed in FIG. 1 by a coil spring 46. The edge portion of the cleaning blade 10 is brought into contact with the photosensitive drum 2 under the effect of the coil spring 46. The bracket 45 includes a control lever 45*a* whose control portion is allowed to expose outwardly of the unit case 8**.

When the control lever **45*a* is pushed upwardly clockwise as viewed in FIG. 1, the bracket 45 is turned about the support shaft 8*a* to bring the cleaning blade 10 spaced away from the photosensitive drum 2. As a consequence, the photosensitive drum 2** can rotate freely.

In order to mount the charge portion unit 7 on the apparatus body 1, the charge portion unit 7 is gradually inserted into the apparatus body 1 from this side along an apparatus body rail 1C while maintaining the clockwise pushing-up operation as viewed in FIG. 1 with respect to the control lever **45*a*. Although the charge roller 9 is in contact with the photosensitive drum 2 under the effect of the coil spring 13, no problem is involved because the charge roller 9 is rotated in response to the rotation of the photosensitive drum 2**.

In this embodiment, the cleaning blade 10 is separated from the photosensitive drum 2 by manually pushing up the control lever **45*a*. It should be appreciated, however, that the present invention is not limited to this embodiment. For example, an arrangement is possible in which a cut-out or a projection is formed on a part of the apparatus body rail 1C and the cleaning blade 10 is semiautomatically actuated by bringing the cut-out or projecting into engagement with the control lever 45*a* when the charge portion unit 7** is inserted.

When the portion on that side of the charge portion unit 7 is inserted into the apparatus body 1, the turning lever 12 on that side is brought into contact with the pressing cam **5*a* provided on the front corner portion of the tip of the slider 5. As a consequence, a portion on that side of the charge roller 9 is brought out of connection with the photosensitive drum 2. At that time point, the portion on this side of the charge roller 9 is still in contact with the photosensitive drum 2**.

The charge portion unit 7 is continuously inserted into the apparatus body 1, and the rotational driving shaft 36 provided on the rear side plate **1*b* of the apparatus body 1 is inserted into the positioning hole 40 formed in the mounting sleeve portion 33. As a consequence, the portion on that side of the photosensitive drum 2 is correctly positioned with respect to the apparatus body 1** and rotatably supported.

At that time, the drive transmission pin 39 disposed on the rotational driving shaft 36 is entered into the space formed between the adjacent follower elements 41 within the mounting sleeve portion 33. Also, the bearing portion 42 of the unit case 8 is engaged with the outer wheel of the ball bearing 35, thereby correctly positioning the portion on that side of the unit case 8 on the apparatus body 1.

In the foregoing state, the turning lever 12 is also brought into abutment with the pressing cam 5*a*. Consequently, the charge roller 9 is completely separated or spaced away from the photosensitive drum 2. This distance of separation is set, for example, 2 mm to 3 mm. Opposite corner portions of the pressing cam 5*a* and the corner portions on this side of the pressing cam 5*b* are, as shown in FIG. 2, defined as inclination surfaces 5*c*, 5*d* and 5*e* having a predetermined angle of inclination with respect to the attaching/detaching direction of the charge portion unit 7. The inclination surfaces 5*c*, 5*d* and 5*e* smoothly guide the turning lever 12 to the crest portion of the pressing cams 5*a* and 5*b* when the charge portion unit 7 is mounted on the apparatus body 1. They exhibit the same functions when the charge portion unit 7 is removed from the apparatus body 1.

It should be noted that since the turning lever 12 on that side does not go beyond the corner portions on that side of the pressing cam 5*b*, the inclination surface is not necessary for the corner portions on that side of the pressing cam 5*b*.

Next, the follower elements 41 of the mounting sleeve portion 33 will be described in detail with reference to FIGS. 4 to 11 inclusive.

Within the mounting sleeve portion 33, there exists a space or gap as an insertion portion 33*a* of the drive transmission pin 39, the insertion portion 33*a* (gap) being sandwiched between adjacent follower elements. The end portion of each follower element 41 on the opening portion side of the mounting sleeve portion 33 is, as shown in FIGS. 3 to 8, formed by two inclination surfaces 41*a*, 41*a* inclining downwardly in the inserting direction of the drive transmission pin 39. As a consequence, the inserted drive transmission pin 39 can be reliably entered into the insertion portion 33*a* guided by the inclination surfaces 41*a* in spite of its abutment with the end portion of the follower element 41.

Here, since the rotational driving shaft 36 is connected to the driving source through the pulley 37 and the belt 38, a large torque is required to rotate the rotational driving shaft 36 from its stop position. Therefore, when the drive transmission pin 39 is entered into the insertion portion 33*a*, the follower element 41 (i.e., photosensitive drum 2) is turned by the pressing force exerted from the drive transmission pin 39.

Figure 5:
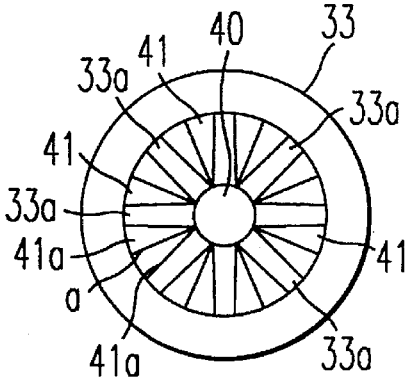
FIG. 5 is a side view of the mounting sleeve portion as viewed from the left-hand side direction of FIG. 3.
Figure 6:
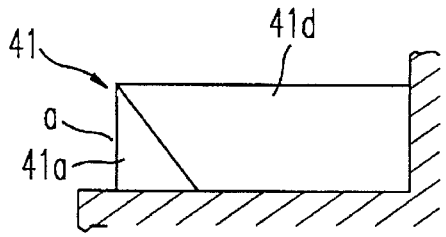
FIG. 6 is a front view showing a follower element of the mounting sleeve portion on an enlarged scale.
Figure 7:
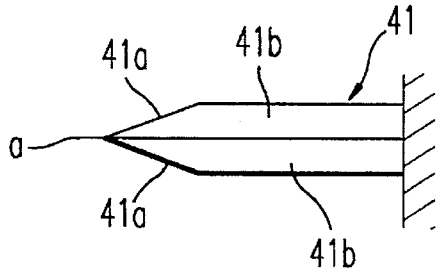
FIG. 7 is a plan view showing the follower element of the mounting sleeve portion on an enlarged scale.
Figure 8:
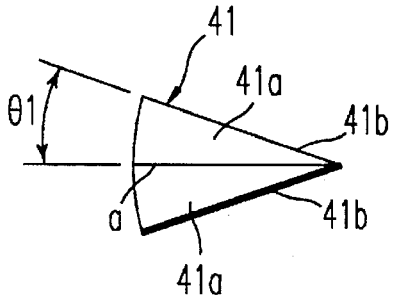
FIG. 8 is a left side view of the follower element of the mounting sleeve portion on an enlarged scale.

In this embodiment, eight (8) follower elements 41 are formed within the mounting sleeve portion 33, and the insertion portions 33*a* of the drive transmission pin 39 are formed at intervals of 45 degrees (see FIG. 5). An angle formed by and between the side surfaces 41*b* and 41*b* of each follower element 41 is 45 degrees.

Therefore, when viewed from the opening side of the mounting sleeve portion 33, i.e., when viewed from the axial direction of the mounting sleeve portion 33, if the ridge lines a of the crest portions formed by intersection of the inclination surfaces 41*a* forming the end portions of the follower elements 41 are formed in the area bisecting the angle (45 degrees), an angle formed between each ridge line a and each side surface 41*b* is 22.5 degrees when viewed from the same direction. This angle (22.5 degrees) is equal to the maximum angle of rotation θ1 for the follower elements 41. It should be noted that this maximum angle of rotation θ1 for the follower element 41 is, of course, changeable depending on intervals of formation of the insertion portions 33*a*, position of formation of the ridge line a at the end portion of the follower element 41, etc.

In the present invention, the mounting sleeve portion 33 is designed such that the maximum angle of rotation θ1 of the follower element 41 is smaller than θ of FIG. 1 when the drive transmission pin 39 is received in the insertion portion 33*a*.

$$\theta > \theta 1$$

Here, θ of FIG. 1 represents an angle of rotation which occurs when the foreign matters at the contact area of the cleaning blade 10 on the photosensitive drum 2 are moved to the contact area of the charge roller 9.

That is, for mounting the charge portion unit 7 on the apparatus body 1, in the image formation device of this embodiment, the cleaning blade 10 is kept spaced away from the photosensitive drum 2 in order to allow the photosensitive drum 2 to rotate freely as mentioned above. When the charge portion unit 7 is mounted on the apparatus body 1 in that state, the drive transmission pin 39 interferes the follower elements 41, so that the follower elements 41 (i.e., photosensitive drum 2) are turned as mentioned above.

Consequently, if the maximum angle of rotation θ1 is larger than θ and the turning direction of the follower element 41 is clockwise as viewed in FIG. 1, the foreign matters, such as remaining toner dammed by the cleaning blade 10, go around in the direction of the contact area of the charge roller 9 and adhere to the charge roller 9.

There is, of course, no problem if the construction of the image formation apparatus is such that when the charge portion unit 7 is mounted on the apparatus body 1, the charge roller 9 is spaced away from the photosensitive drum 2. However, the above-mentioned inconvenience is encountered in the case where the charge roller 9 is in contact with the photosensitive drum 2 when the charge portion unit 7 is mounted on the apparatus body 1 as in the case with the apparatus of the above embodiment.

Therefore, in the present invention, it is set to θ>θ1 in order to prevent the foreign matters, which have been dammed by the cleaning blade 10 until that time, from moving so far as to the contact area of the charge roller 9 when the charge portion unit 7 is mounted on the apparatus body 1.

When the photosensitive drum 2 is rotated clockwise as viewed in FIG. 1 within the range of θ>θ1 at the time the charge portion unit 7 is mounted on the apparatus body 1, the mounting operation is completed with the foreign matters, which have been dammed by the cleaning blade 10 until that time, located within the range shown by θ in FIG. 1. At that time, the charge roller 9 is also in a position spaced away from the photosensitive drum 2. When the charge roller 9 is brought into contact with the photosensitive drum 2 from that state at the same time the apparatus starts operation, the foreign matters located in the range shown by θ of FIG. 1 adhere to the charge roller 9.

In view of the above, in the present invention, the timing of contacting/separating operation of the charge roller 9 is set such that the charge roller 9 is prohibited from contacting the photosensitive drum 2 during the time after the apparatus starts operation until the time the foreign matters in the range shown by θ pass the contact area of the charge roller 9. FIG. 12 is a timing chart showing such an operation timing.

Here, the time t [sec.] from the time the photosensitive drum 2 starts rotation until the time the charge roller 9 is brought into contact with the photosensitive drum 2 can be obtained as follows.

If the peripheral speed of the photosensitive drum 2 is represented by V [mm/sec.]; the radius of the photosensitive drum 2, r [mm]; the number of rotation of the photosensitive drum 2, N [rpm]; the angle formed between the adjacent normals passing across the areas (contact areas) where the cleaning blade 10 and charge roller 9 contact the photosensitive drum 2, θ [deg]; and the length of the arc on photosensitive drum 2 between those contact areas, L [mm] (see FIG. 1), the arc length can be expressed as follows:

$$L=v\cdot t=2\pi r\cdot\theta/360$$

The above expression (equation) can be rewritten as follows:

$$t=\pi r\cdot\theta/180v$$

If $v=2\pi rN/60$ is substituted for the above expression, the above expression is rewritten as follows:

$$\begin{aligned} t &= \pi r\cdot\theta\cdot 60/(180\cdot 2\pi r\cdot N) \\ &= \theta/6N \end{aligned}$$

Therefore, in order not to allow the foreign matters from adhering to the charge roller 9, the following expression must be satisfied:

$$t>\theta/6N$$

According to a test carried out by the present inventor, the foreign matters can be prevented from adhering to the charge roller 9 by setting; θ1=22.5 degrees and t=0.2 sec in an apparatus of N=63.7 rpm, θ=45 degrees.

Also, in this embodiment, the cam 3 is actuated by a ⅓ rotating charge roller clutch, not shown (this clutch being of the type in which the clutch is connected to a normally rotating shaft, 120 degrees by 120 degrees, and intermittently turned, ⅓ turn by ⅓ turn). It should be noted that the charge roller clutch may be either ½ rotation or ¼ rotation. Here, if n is used to represent the number of divisions (the eccentric cam 3 turns on and off the cam lever 4 at a rotation of 1/n) of the charge roller clutch and Nc, the number of rotations, the following expression can be obtained:

$$\begin{aligned} Nc &= (60/t)\cdot(L/n) \\ &= 60/(t\cdot n)=360N/(n\cdot\theta) \end{aligned}$$

Thus, in order not to allow the foreign matters from adhering the charge roller 9, the following expression must be satisfied:

$$Nc<360N/(\theta\cdot n)$$

On the other hand, those foreign matters, which have passed without adhering to the charge roller 9, are allowed to enter the developing device 15, where the foreign matters are scraped off by the magnetic brush and then removed again by the cleaning blade 10.

In the above embodiment, the ⅓ rotating clutch (contact-to-charge contacting/separating means) is employed for contacting and separating the charge roller 9. In the alternative, a solenoid may be used as the means. In that case, after the passage of the time t from the time the photosensitive drum 2 starts its rotation, the solenoid is turned on to contact the charge roller 9.

Figure 4:
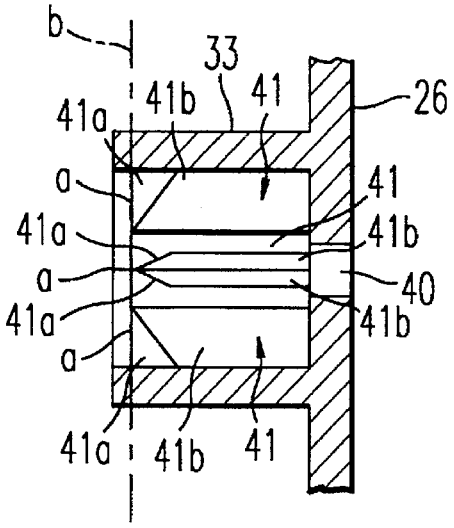
FIG. 4 is a vertical sectional view showing a mounting sleeve portion formed on a photosensitive drum of the image formation apparatus of FIG. 1.

Also, the ridge lines a of the crest portions formed by intersection of the inclination surfaces 41*a* forming the end portions of the follower elements 41 are arranged in an imaginary plane b generally perpendicular to the entry direction (axial direction of the mounting sleeve portion 33 in this embodiment) of the drive transmission pin 39 (see FIG. 4).

Presuming that a ridge line a of the crest portion is formed with an inclination with respect to the imaginary plane b as shown in FIGS. 10 and 11, a distal end of the drive transmission pin 39 normally contacts the ridge line a in the form of a point contact when the drive transmission pin 39 contacts the ridge line a (see FIG. 11), and therefore, a large collision pressure acts on the ridge line a portion of each follower element 41. If such a collision pressure acts repeatedly on the ridge line a portion, the ridge line a portion is subjected to damages such as cracks and cut-outs. Those damaged portions are adversely affected to a smooth coupling operation of the drive transmission pin 39 because the pin 39 is caught by those cracks and cut-outs.

In view of the above, in this embodiment, as shown in FIG. 4, the ridge lines a of the crest portions are placed on the above-mentioned imaginary place so that the drive transmission pin 39 contacts in the form of a line contact (see FIG. 9), in order to disperse the shocks at the time of contact. As a consequence, the ridge line a portion of the crest portion of each follower element 41 is not easily damaged and can be subjected to a smooth connection for a long time.

In the above-mentioned embodiment, only the contact timing of the charge roller 9 at the first starting time after the charge portion unit 7 is mounted on the apparatus body 1 has been described. For example, in the image formation apparatus of the type in which the carrier cleaning means is separated from the image carrier whenever the image carrier stops, the contacting action of the contact-to-charge means with respect to the image carrier is delayed by the above-mentioned t whenever the image carrier is started to operate.

Next, a second embodiment of the present invention will be described with reference to the accompanying drawings.

Figure 13:
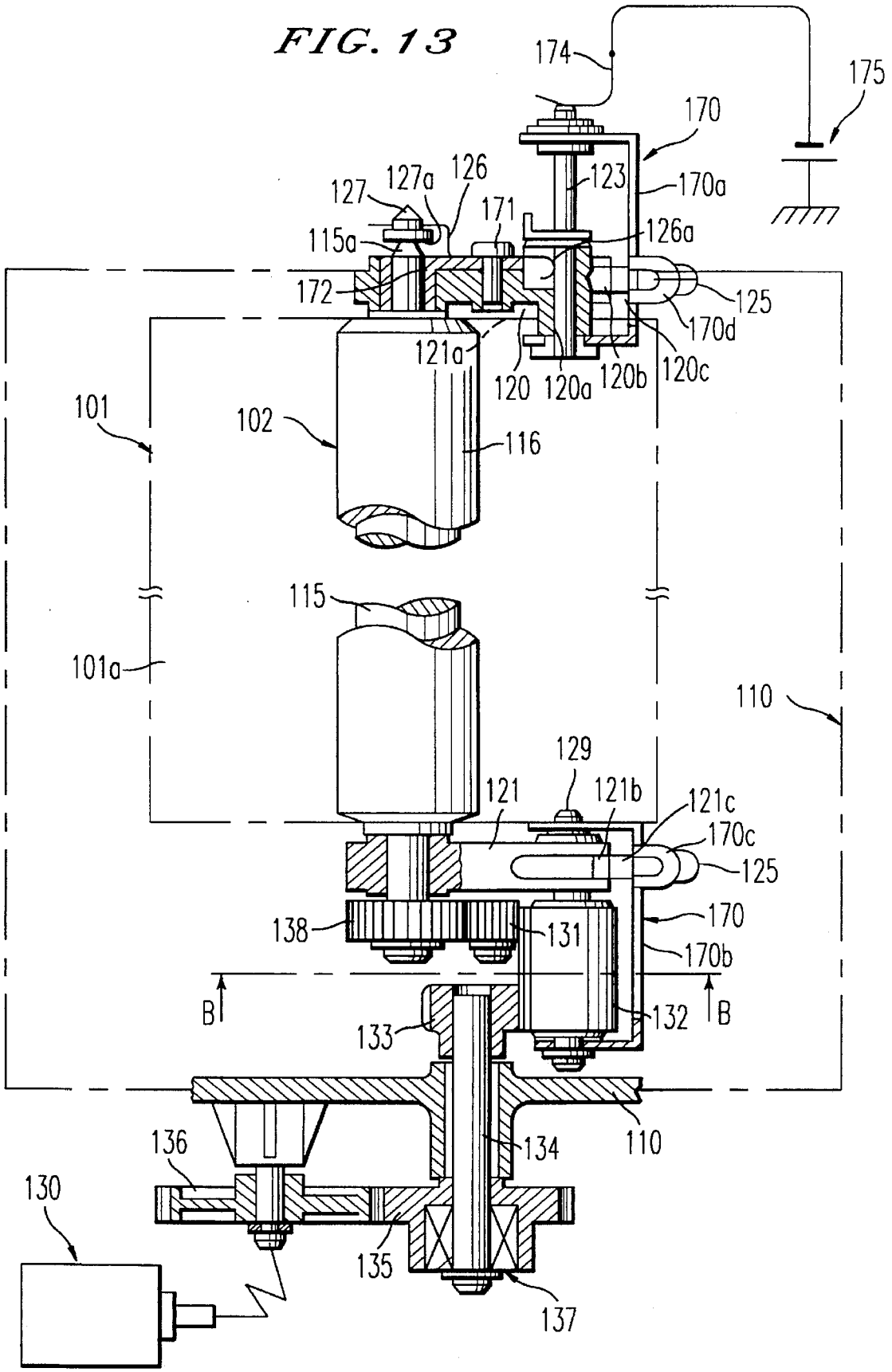
FIG. 13 is a plan view showing a charge roller and its nearby area of an image formation apparatus according to a second embodiment of the present invention.

FIG. 13 is a plan view showing a construction of a charge roller and its nearby area, of an image formation apparatus according to the second embodiment of the present invention.

The image formation apparatus according to this second embodiment includes a cleaning member (charge cleaning means) for performing a cleaning operation while rotationally driving a charge roller as a contact-to-charge means, as later described. An overall construction of the image formation apparatus is generally the same to that of the image formation apparatus according to the first embodiment shown in FIG. 1. Such component members as a photosensitive drum 101 as an image carrier, a charge roller 102 as a contact-to-charge means and a cleaning blade as a carrier cleaning means, are attached to a unit case 110, so that those component members can be attached and detached freely with respect to the apparatus body, as a unit.

The charge roller 102 comprises an electrically-conductive rubber roller portion 116 integrally attached to the outer side of an electrically-conductive core 115 made of iron or the like, as shown in FIG. 13. Opposite ends of the core 115 are rotatably supported respectively by bearings 120 and 121 made of resin.

The bearing 120 is adapted to support the electrically-conductive core 115 of the charge roller 102 and the electrically-conductive support shaft 123 facing in the same axial direction. The electrically-conductive core 115 is turnably pierced into a hole 120*a*. Opposite end portions of the support shaft 123 are supported by a feeder side support portion 170*a* of a bracket 170 formed of a steel plate bent into a generally U-shape. Owing to the foregoing arrangement, the bearing 120 is capable of turning about the support shaft 123.

The electrically-conductive core 115 of the charge roller 102 forms its upper end portion 115*a* as viewed in FIG. 13 on a spherical surface, and the end portion 115*a* is in contact with a flat surface portion 127*a* of a feed terminal 127.

Figure 14:
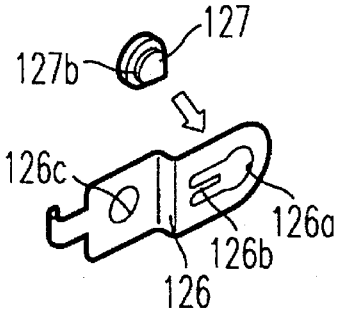
FIG. 14 is a perspective view showing an electrically-conductive feed plate and a feed terminal, which are adapted to supply a high voltage to the charge roller of FIG. 1.
Figure 15:
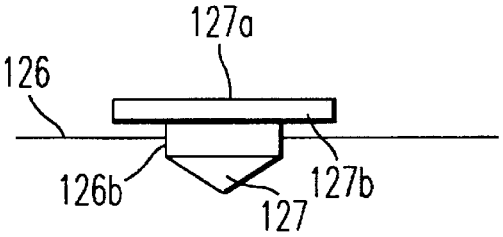
FIG. 15 is a plan view showing the electrically-conductive feed plate already attached with the feed terminal.

The feed terminal 127 has a collar 127*b* as shown in FIGS. 14 and 15. This collar 127*b* is pushed into a hole 126*a* formed in an electrically-conductive plate 126 having spring properties until it contacts the surface of the plate 126 and in that state, the collar 127*b* is prevented from being escaped by a claw portion 126*b* formed on the electrically-conductive plate 126 (see FIG. 14).

Also, the electrically-conductive plate 126 is provided with a mounting hole 126*c* as shown in FIG. 14, and a screw 171 is inserted into the mounting hole 126*c* as shown in FIG. 13. The screw 171 is threadedly engaged in an internally-threaded hole 121*a* formed generally in the center of the bearing 120 to thereby firmly secure the electrically-conductive plate 126 to the bearing 120.

An electrically-conductive member 172 is interposed between the electrically-conductive plate 126 and the bearing 120. An inner peripheral surface of a contact area extending up to the charge roller 102 of the electrically-conductive member 172 is kept in contact with an outer peripheral surface of the electrically-conductive core 115 which forms the charge roller 102. In that state, a curled portion 126*d* at one end (right-hand side as viewed in FIG. 13) of the electrically-conductive plate 126 is in contact with an outer peripheral surface of the support shaft 123 under a predetermined contact pressure so that the electrically-conductive plate 126 and the bearing 120 are electrically conducted.

Also, a contactor 174 having spring properties is brought into contact with one end of the support shaft 123 and this contactor 174 is brought into contact with a high voltage power source 175. As a consequence, a high voltage from the high voltage power source 175 is supplied to an electrically-conductive core 115 of the charge roller 102.

On the other hand, the bearing 121 rotatably supports the other end portion of the charge roller 102 and also rotatably supports the support shaft 129. Opposite end portions of the support shaft 129 are supported by a driving side support portion 170*b* of the bracket 170. Owing to this arrangement, the bearing 121 is turnable about the support shaft 129.

There are a gear 132 and a roller driving gear 138 which are rotatably axially supported by the bearing 121, and an intermediate gear 131 is engaged with and between those gears. The roller driving gear 138 is secured to one end of the electrically-conductive core 115 of the charge roller 102.

Also, the gear 132 is in engagement with a transmission gear 133 which is secured to one end of the gear support shaft 134, whereas a driving gear 135 is mounted on the other end of the gear support shaft 134 through a one-way clutch 137. Here, the gear support shaft 134 is rotatably supported by the unit case 110.

Further, a driving force transmission gear 136, which is rotatably supported by the unit case 110, is engaged with the driving gear 135, and this driving force transmission gear 136 is rotated by receiving a rotational driving force from a motor 130 for rotationally driving the photosensitive drum 101.

The motor 130 is installed on the apparatus body (not shown), so that when the unit case 110 is mounted on the apparatus body, it is connected to the driving force transmission gear 136 through a power transmission mechanism, not shown.

As later described, the surface peripheral speed of the charge roller 102, which is in a position spaced away from the photosensitive drum 101, is slower than the surface peripheral speed when it is in contact with the photosensitive drum 101 and rotated accompanying with the drum 101. The one-way clutch 137 transmits the rotational driving force from the driving force transmission gear 136 to the gear support shaft 134 when the charge roller 102 is separated away from the photosensitive drum 101, and relatively idly rotates the gear support shaft 134 by a difference in number of rotation between the driving gear 134 and the gear support shaft 134 when the charge roller 102 is rotated accompanying with the photosensitive drum 101.

Figure 16:
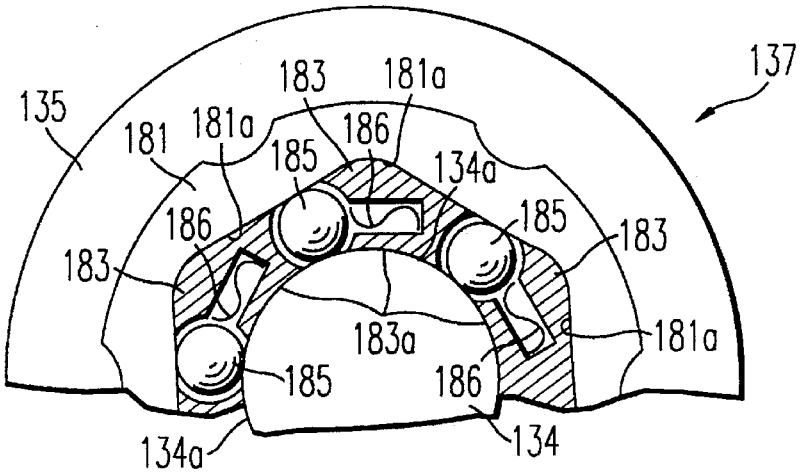
FIG. 16 is a diagrammatic view showing an internal construction of a one-way clutch assembly for transmitting a driving force to the charge roller.

FIG. 16 is a schematic view showing an internal construction of the one-way clutch 137.

The one-way clutch 137 has a clutch housing 181 to which the driving gear 135 is secured. A plurality of spring retainer blocks 183 are secured at predetermined intervals to an inner peripheral surface of the clutch housing 181. A space large enough for a roller 185 to rotate therein and move slightly in the peripheral direction is formed between adjacent the spring retainer blocks 183. The rollers 185 are each inserted in each of those spaces. Each roller 185 is biased counterclockwise as viewed in FIG. 16 by a spring 186.

The gear support shaft 134 is rotatably fitted to the inner peripheral surfaces of the spring retainer blocks 183. Here, a wedge-like space is formed between the inner peripheral surface 181*a* of the clutch housing 181 and the gear support shaft 134, so that force for moving the respective rollers 185, which are in contact with the outer peripheral surface 134*a* of the gear support shaft 134, counterclockwise as viewed in FIG. 16, acts on them when they tend to relatively rotate counterclockwise as viewed in FIG. 16 with respect to the driving gear 135, and the rollers 185 are fixedly sandwiched and locked by and between the inner peripheral surface 181*a* of the clutch housing 181 and the gear support shaft 134.

As a consequence, the driving gear 135 secured to the clutch housing 181 and the gear shaft 134 are connected by the respective rollers 185.

On the contrary, when the gear support shaft 134 is relatively rotated clockwise as viewed in FIG. 16 with respect to the driving gear 135, the respective rollers 185 are also moved clockwise as viewed in FIG. 16 against the effects of the respective springs 186. As a consequence, the rollers 185 are moved respectively to enlarged width portions in the wedge-like spaces, to thereby remove the locked state. Consequently, the clutch housing 181 and the gear support shaft 134 become relatively rotatable, and the driving gear 135 and the gear support shaft 134 are relatively rotated to provide an idly rotating state.

In this embodiment, gear ratio of each of the above-mentioned gears is set such that a surface peripheral speed V of the time when the charge roller 102 is spaced away from the photosensitive drum 101 and rotated by rotational driving force from the driving gear 135 is slow with respect to a surface peripheral speed V0 of the time when the charge roller 102 is rotated contacting the photosensitive drum 101.

Therefore, when the charge roller 102 of FIG. 13 is in the state where the roller 102 is in contact with the photosensitive drum 101 and rotated accompanying with the photosensitive drum 101, the roller driving gear 138, intermediate gears 131, 132, transmission gear 133 and gear support shaft 134 are all rotated by the driving force transmitted from the photosensitive drum 101.

It should be noted that when there is no space limitation, the one-way clutch 137 may be disposed within the roller driving gear 138. If so arranged, the driving force is not transmitted to the intermediate gear 131, intermediate gears 131, 132, transmission gear 133, driving gear 135, etc. when the charge roller 102 is rotated accompanying with the photosensitive drum 101, and therefore, driving loads can be reduced.

Next, a contact-to-charge contacting/separating means 140 for bringing the charge roller 102 into or out of contact with the photosensitive drum 101 will be described with reference to FIGS. 17 to 23.

Figure 17:
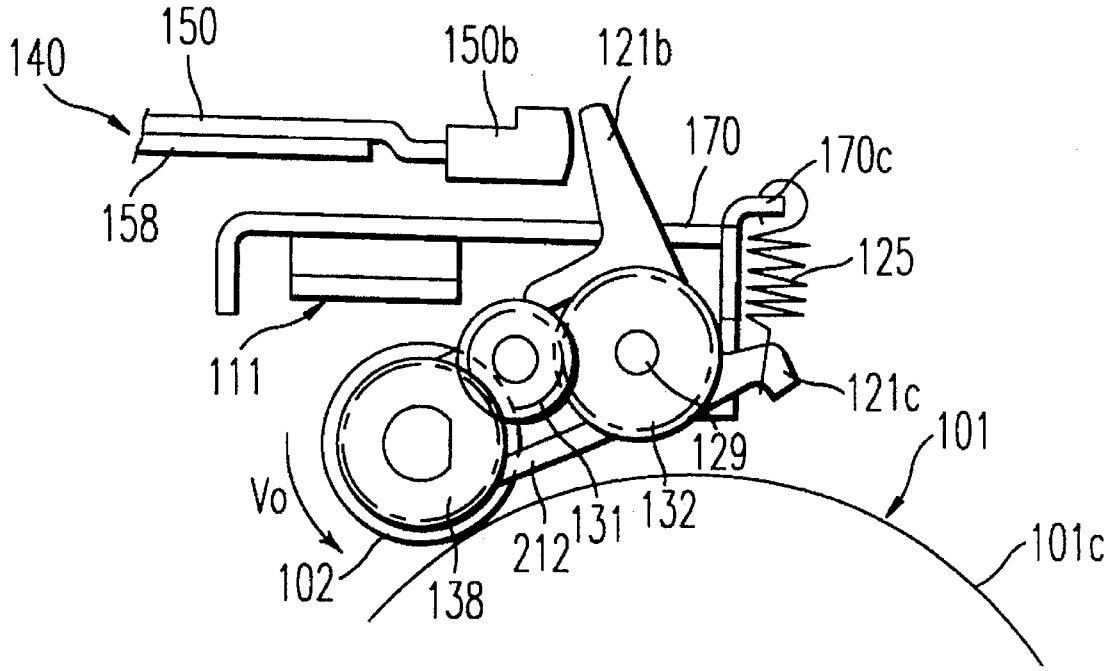
FIG. 17 is a sectional view taken on line B—B of FIG. 1, showing a state in which the charge roller is in contact with the photosensitive drum by a contacting/separating means.
Figure 18:
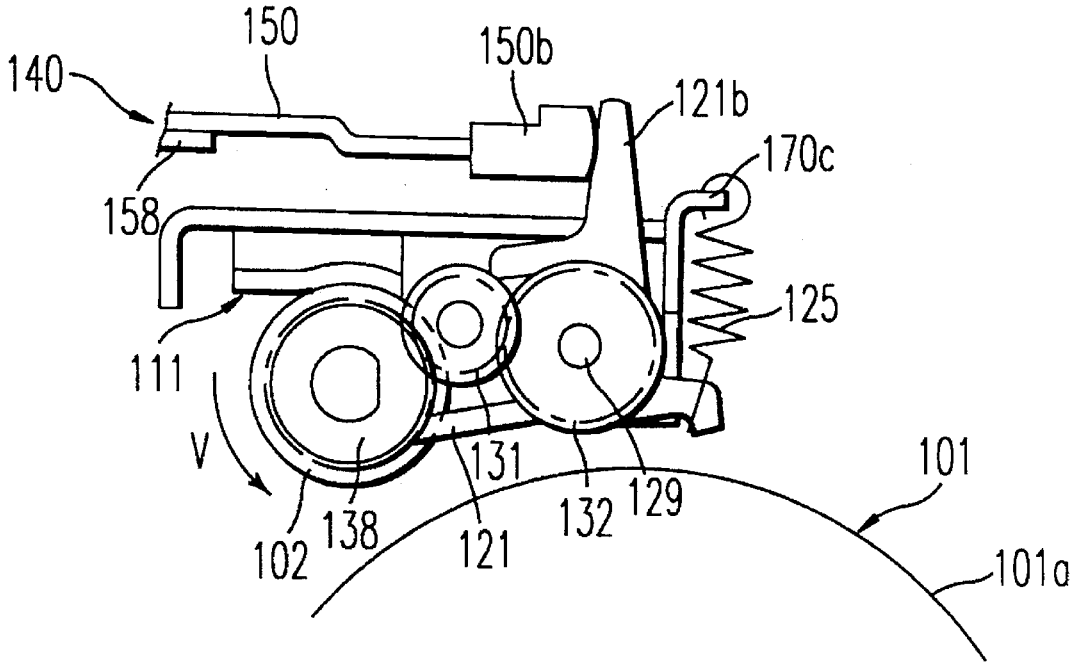
FIG. 18 is a sectional view taken on line B—B of FIG. 1, showing a state in which the charge roller is spaced away from the photosensitive drum.

The bearing 121 for rotatably supporting the electrically-conductive core 115 of the charge roller 102 includes a lever portion 121*b* projecting from an upper surface of the bracket 170 and a hook retainer 121*c*, as shown in FIGS. 17 and 18. On the other hand, a hook retainer 170*c* is also formed on the bracket 170. A tension spring 125 is disposed between the hook retainers 121*c* and 170*c*.

Accordingly, the bearing 121 is biased counterclockwise as viewed in FIG. 17 about the support shaft 129 under the biasing force of the tension spring 125, and the charge roller 102 is brought into contact with the surface 101*a* of the photosensitive drum 101 under a predetermined contact pressure suitable for charging by this biasing force and rotated accompanying with the photosensitive drum 101.

Similarly, a lever portion 120*b* and a hook retainer 120*c* are also formed on the bearing 120 shown in FIG. 13. On the other hand, a hook retainer 170*c* is also formed on the bracket 170. A tension spring 125 is disposed between the hook retainers 120*c* and 170*d*.

Accordingly, the bearing 120 is also biased counterclockwise about the support shaft 123 by the tension spring 125, and the charge roller 102 is brought into contact with the surface 101*a* of the photosensitive drum 101 by the biasing force of the tension spring 125.

When the image formation process is finished, the lever portion 120*b* of the bearing 120 and the lever portion 121*b* of the bearing 121 are simultaneously pressed respectively by the pressing cams 150*a* (see FIG. 20) and 150*b* of the contact-to-charge contacting/separating means 140 shown in FIG. 17 and turned clockwise as viewed in FIG. 18. By this, the charge roller 102 is brought away or separated from the surface 101*a* of the photosensitive drum 101.

In the separated position, the charge roller 102 contacts a cleaning member 111, as a charge cleaning means, which is secured to an inner surface of the bracket 170, as shown in FIG. 18. At that time, the rotational driving force from the motor 130 is transmitted to the charge roller 102 through the one-way clutch 137 shown in FIG. 13. As a consequence, the charge roller 102 contacts the cleaning member 111 while rotating, and foreign matters such as toner and paper powder, which are adhered to the surface of the charge roller 102, are removed.

When the charge roller 102 and the photosensitive drum 101 are contacted and separated with respect to each other, the pressing cams 150*a* and 150*b* are required to simultaneously actuate the lever portion 120*b* of the bearing 120 and the lever portion 121*b* of the bearing 121 at the same phase. For this purpose, the pressing cams 150*a* and 150*b* are provided on a single canceling (or releasing) slider 150, as shown in FIGS. 18 and 19.

In the canceling slider 150, elongate openings 150*c* and 150*d* are formed in directions as indicated by a two-headed arrow C, and elongate openings 150*e* and 150*f* are also formed in directions as indicated likewise by two-headed arrow D, perpendicular to the arrow C directions. Here, the arrow C directions are contacting/separating directions for the pressing cams 150*a* and 150*b* with respect to the lever portions 120*b* and 121*b*, respectively.

Pins 159, 159 erected straight up on a holding bracket 158 are movably inserted in the elongate openings 150*c* and 150*d*, respectively, and L-shaped levers 151, 151 are turnably inserted into the pins 159, 159, respectively. The levers 151, 151 have pins 191, 191 projecting downwardly from one end portion thereof, respectively. The pins 191, 191 are inserted into the elongate openings 150*e*, 150*f* of the canceling slider 150, and into elongate openings 158*a*, 158*b* formed in the holding bracket 158, respectively. Further, C-rings, not shown, are attached to head portions of the pins 159, 159 in order to prevent escape.

Figure 19:
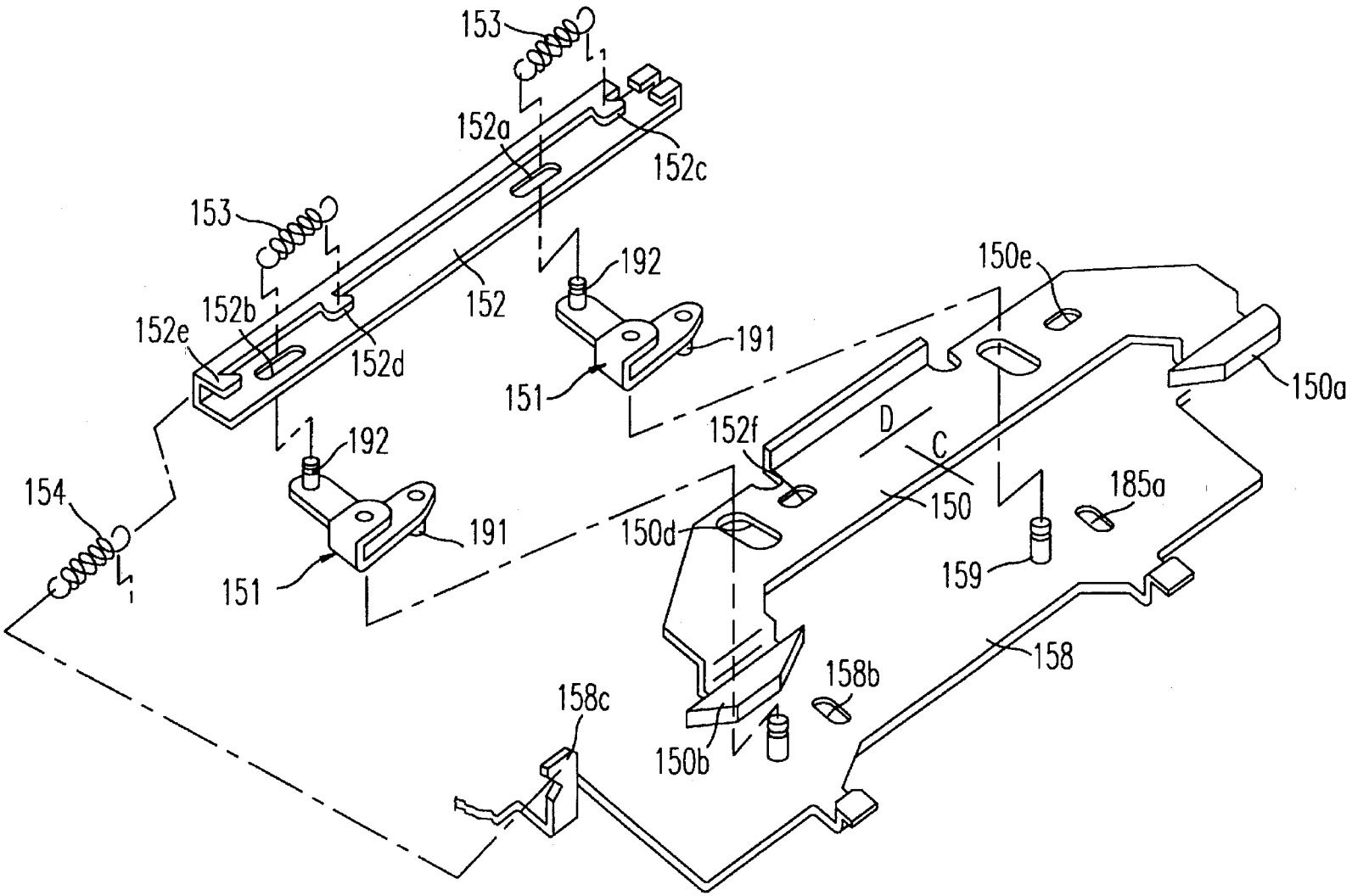
FIG. 19 is an exploded perspective view for explaining the contacting/separating means.

Also, the levers 151, 151 respectively have pins 192, 192 projecting upwardly from the other end portions thereof as shown in FIG. 19. The pins 192, 192 are inserted respectively into elongate openings 152*a*, 152*b* formed in a link 152, and tension springs 153, 153 are disposed respectively between distal end portions of the pins 192, 192 and hook retainers 152*c*, 152*d* formed on the link 152.

Figure 20:
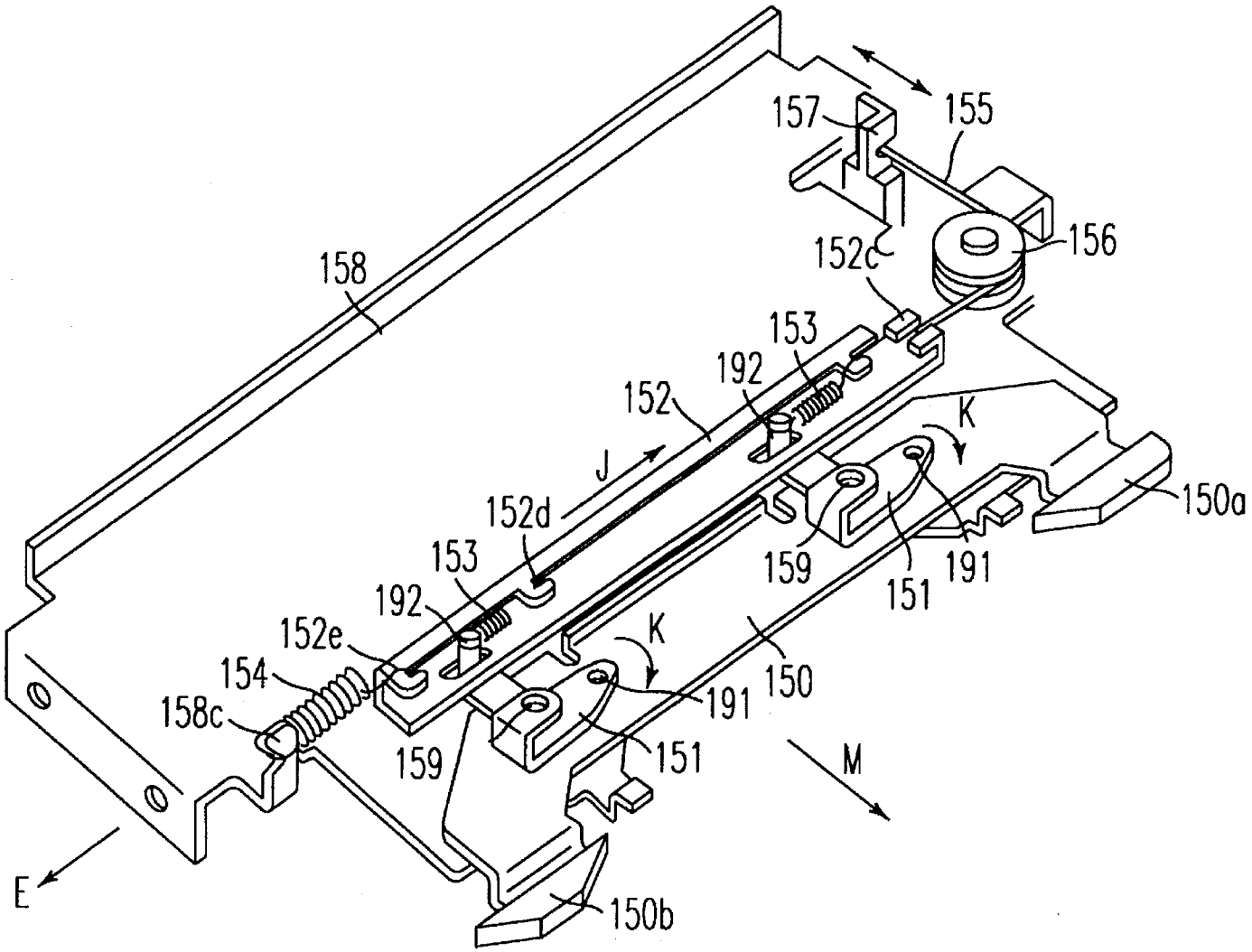
FIG. 20 is a perspective view showing how to attach the contacting/separating means of FIG. 8.

As shown in FIG. 20, one end of a tension spring 154 is engaged with a hook retainer 152*e* which is formed on one end of the link 152, and a hook retainer 158*c* of the holding bracket 158 is engaged with the other end of the tension spring 154. Owing to this arrangement, the link 152 is biased in a direction as shown by an arrow E of FIG. 20.

One end of a driving wire 155 is secured to the other end of the link 152. The driving wire 155 is trained around a pulley 156 which is rotatably supported by the holding bracket 158 and then its trailing direction is shifted by 90 degrees. Thereafter, the driving wire 155 is connected to a distal end portion of the turnable lever 157.

Figure 21:
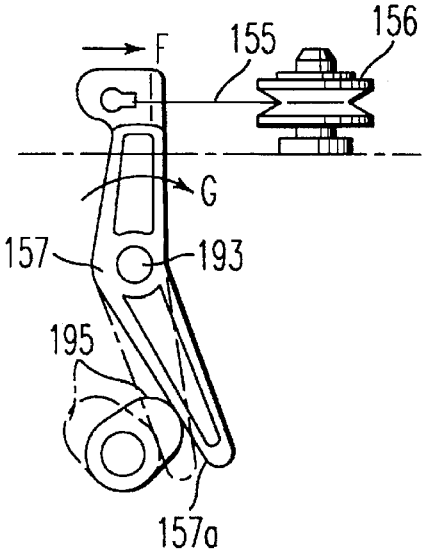
FIG. 21 is a diagrammatic view showing a nearby area of a cam for actuating the contacting/separating means.

As shown in FIG. 21, the turnable lever 157 is turnably supported at its generally central portion by a shaft 193, and a lower end portion 157*a* of the turnable lever 157 allows a cam 195 to contact it.

As described above, the link 152 is biased in the arrow E direction by the tension spring 154. Due to the foregoing arrangement, since the driving wire 155 is biased in that direction, it is biased in a direction as shown by an arrow F. As a consequence, the turnable lever 157 is rotationally biased in a direction as shown by an arrow G, so that a left surface 157*a* of the lever 157 is urged against the cam 195.

The contact-to-charge contacting/separating means 140 is constructed as mentioned above. When the charge roller 102 is separated or brought away from the photosensitive drum 101, the cam 195 is turned to a position as indicated by a solid line of FIG. 21. Then, the turnable lever 157 is turned in a direction opposite to the arrow G direction. Since the driving wire 155 is moved leftwardly as viewed in FIG. 21, the link 152 shown in FIG. 20 is moved in a direction as shown by an arrow J.

Figure 22:
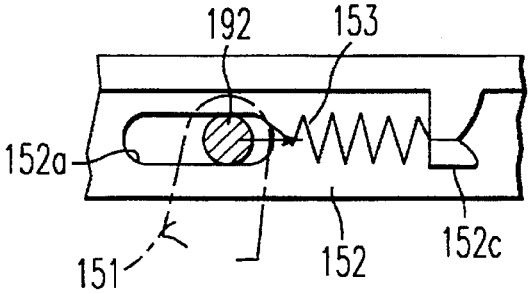
FIG. 22 is a plan view showing a positional relation between a lever of the contacting/separating means and an elongate opening formed in a link, in a state in which the charge roller is spaced away from the photosensitive drum.
Figure 23:
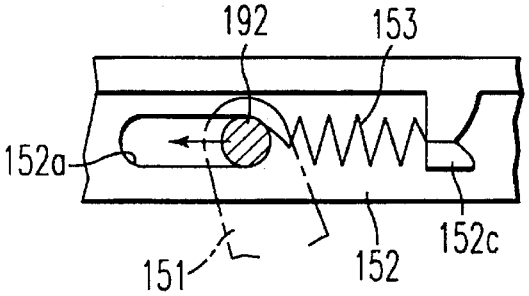
FIG. 23 is a plan view showing a positional relation between the lever of the contacting/separating means and the elongate opening, in a state in which the charge roller is in contact with the photosensitive drum.

As a consequence, since the pins 192, 192 of the levers 151, 151 are moved rightwardly as viewed in FIG. 22, the levers 151, 151 are turned in a direction as shown by an arrow K of FIG. 20. In response to this movement, the canceling slider 150 is moved in a direction as shown by an arrow M through the pins 191, 191 of the levers 151, 151.

Consequently, the pressing cams 150*a*, 150*b* simultaneously press the lever portion 121*b* of the bearing 121 and the lever portion 120*b* of the bearing 120, respectively, and the charge roller 102 is moved from a contact position shown in FIG. 17 to a spaced-away or separated position shown in FIG. 18.

At that time, the charge roller 102 is brought into contact with the cleaning member 111 under a predetermined pressure by the biasing force of the tension spring 153 shown in FIG. 20.

On the other hand, in order to bring the charge roller 102 into contact with the photosensitive drum 101, the cam 195 is turned into a position as indicated by an imaginary line of FIG. 21. Then, the turnable lever 157 is turned in the arrow G direction and the driving wire 155 is brought back in a reverse direction with respect to the above-mentioned case, by the biasing force of the tension spring 154 shown in FIG. 20. As a consequence, the link 152 is moved in that direction. Consequently, the pins 192, 192 of the levers 151, 151 are moved leftwardly as viewed in FIG. 23.

Along with this movement, the levers 151, 151 shown in FIG. 120 are turned in a direction opposite to the arrow K direction, and the canceling slider 150 is moved in a direction opposite to the arrow M direction. As a consequence, the pressing cams 150*a*, 150*b* are brought away respectively from the lever portions 120*b*, 121*b*. Consequently, the charge roller 102 is moved from the separated or spaced-away position shown in FIG. 18 to the contact position shown in FIG. 17 by the biasing force of the tension spring 125, so that the charge roller 102 contacts the surface 101*a* of the photosensitive drum 101 again.

Next, a description will be given of operation of the contact-to-charge contacting/separating means 14 when the unit case 110 including the photosensitive drum 101, the charge roller 102, etc. is mounted on the apparatus body.

Figure 24:
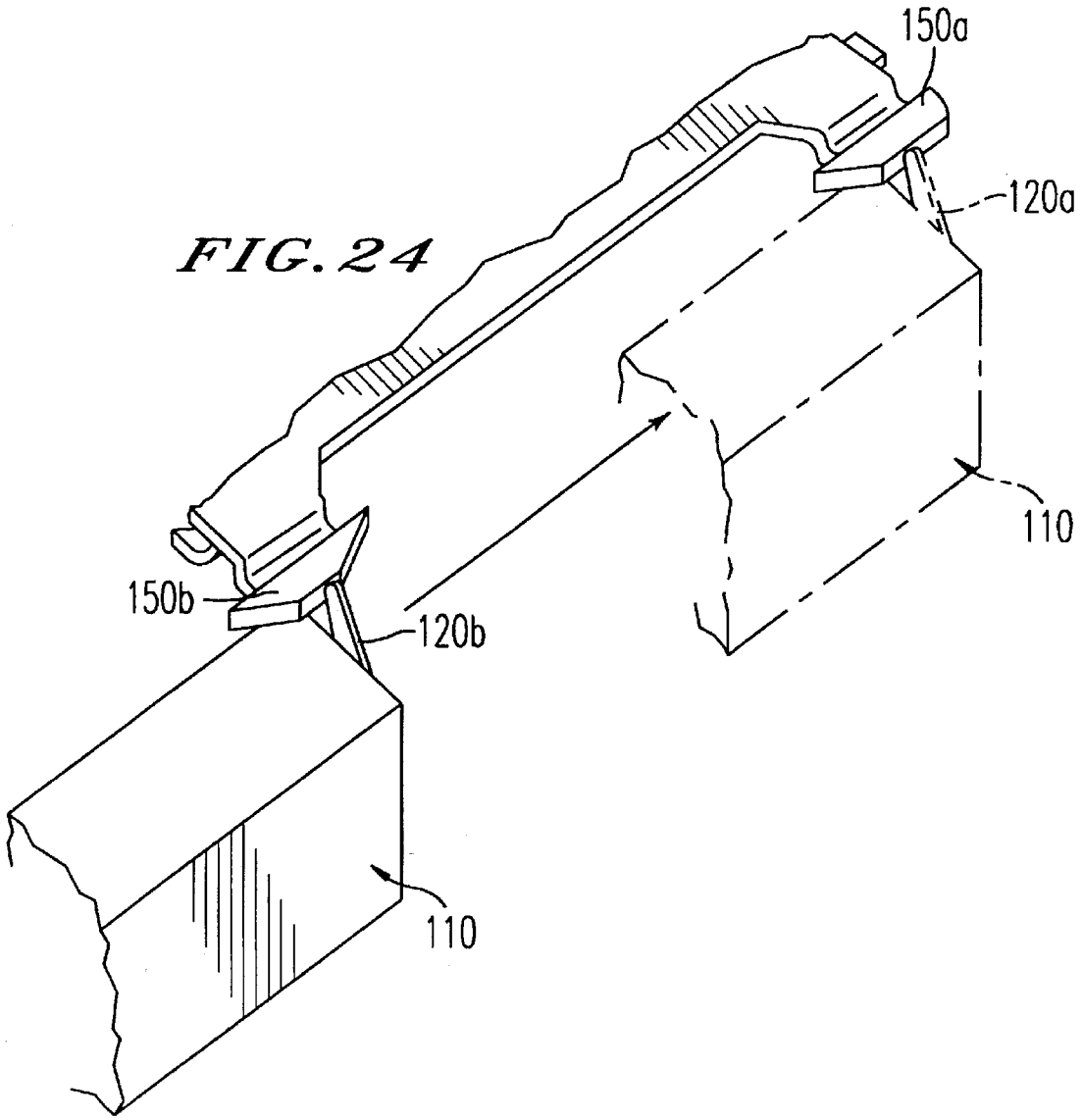
FIG. 24 is a perspective view showing a relation between a pressing cam and a lever when a unit case is attached to the apparatus body.

As the unit case 110 is gradually inserted into the apparatus body, the lever portion 120*b* on that side is brought into abutment with the pressing cam 150*b* on this side first, so that the portion on that side of the charge roller 102 is brought away or spaced away from the photosensitive drum 101, as shown in FIG. 24. As the insertion of the unit case 110 is further progressed, the lever portion 120*b* is separated away from the pressing cam 150*b* and contacts the pressing cam 150*a* on that side immediately before the completion of mounting. At that time, the lever portion 121*b* is also simultaneously brought into abutment with the pressing cam 150*b*, and as a result, the charge roller 102 is separated or spaced away from the photosensitive drum 101.

Here, opposite corner portions of the pressing cam 150*a* and the corner portions on this side of the pressing cam 150*a* are defined as inclination surfaces having a predetermined inclination with respect to the attaching and detaching direction of the unit case 110, as in the case with the first embodiment shown in FIG. 2. At the time when the unit case 110 is mounted on the apparatus body, the lever portions 120*b*, 121*b* are guided by those inclination surfaces and introduced to the crest portions of the pressing cams 150*a*, 150*b*, thereby enabling to provide a smooth attaching operation without a fear of being caught or engaged. Also, when the unit case 110 is removed from the apparatus body, the lever portions 120*b*, 121*b* are guided by those inclination surfaces and introduced to the crest portions of the pressing cams 150*a*, 150*b*, thereby enabling to provide a smooth detaching operation without a fear of being caught or engaged.

Figure 25:
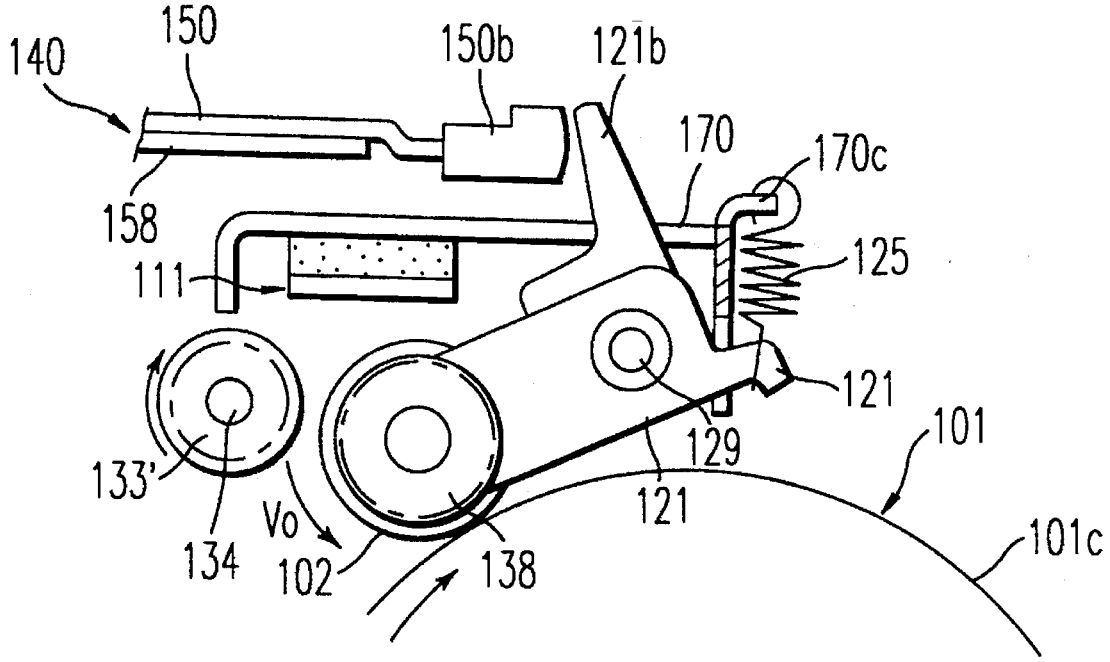
FIG. 25 is a diagrammatic view, like FIG. 6, showing a third embodiment of the present invention.
Figure 26:
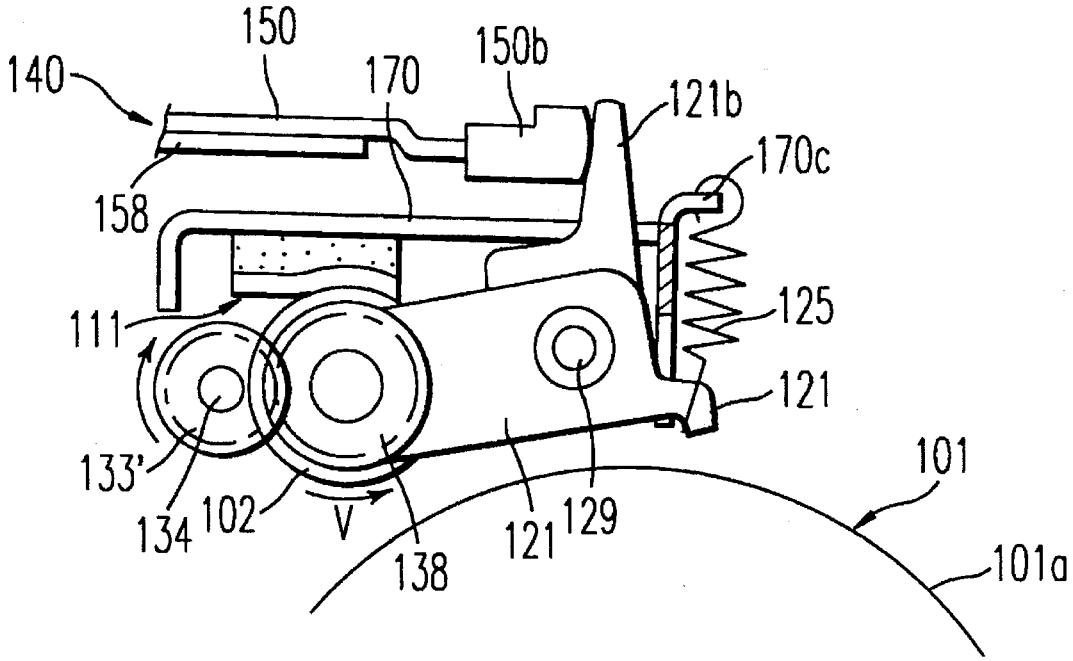
FIG. 26 is a diagrammatic view, like FIG. 7, showing the third embodiment of the present invention.

FIGS. 25 and 26 are diagrammatic views, like FIGS. 17 and 18, showing a third embodiment of the present invention. Those parts corresponding to FIGS. 17 and 18 are denoted by identical reference numerals, respectively.

In the third embodiment, the rotational driving mechanism from the motor 130 to the intermediate gear 131 in the above-mentioned second embodiment is omitted. Instead, it employs an arrangement in which a transmission gear 133' is provided in the vicinity of the cleaning member 111 and this transmission gear 133' is rotationally driven by a motor not shown.

When the charge roller 102 is in a position for contacting the cleaning member 111, the transmission gear 133' is brought into engagement with a roller driving gear 138 disposed on one end of the charge roller 102 so that a rotational driving force from a motor, not shown, is transmitted to the charge roller 102. As a consequence, the charge roller 102 is rotated while contacting the cleaning member 111 so that the foreign matters, such as toner and paper powder, adhered to the surface of the charge roller 102 are removed.

In the previously-described second embodiment, since the rotational driving force from the motor 130 is transmitted to the charge roller 102 even during the time the charge roller 102 is in contact with the photosensitive drum 101 and rotated accompanying with its the peripheral speed given by the driving force of the motor 130 when the charge roller 102 is rotating is made slower than the peripheral speed when the charge roller 102 is rotated accompanying with the photosensitive drum 101, in order to cause an idle rotation for the difference portion between those peripheral speeds by the one-way clutch 137.

However, according to the above-mentioned rotational driving mechanism, since a rotational driving force is transmitted from a motor, not shown, to the charge roller 102 when the charge roller 102 is in a position away from the photosensitive drum 101, the charge roller 102 can be rotated at a desired peripheral speed.

An optimum surface peripheral speed of the charge roller when the charge roller is cleaned, will now be described.

If the number of anti-sliding friction attributable to mechanical tolerance with respect to the surface of the charge roller is represented by Nt; the outer diameter of the charge roller, by d; and the total of cleaning time for the charge roller, by ΣT, respectively, an optimum surface peripheral speed Vc of the charge roller at the time the charge roller is being cleaned can be given by the following equation:

$$Vc=\pi \cdot d \cdot Nt/\Sigma T$$

By setting the optimum surface peripheral speed of the charge roller at the time the charge roller is being cleaned to a value proximate to Vc obtained from the above equation, a stable roller cleaning efficiency can be maintained for a long time without sacrificing the service life of the charge roller.

It should be noted that the present invention is not limited to the above embodiments. For example, it can be applied to various kinds of image formation apparatus which employ an electrophotographic system, such as a laser printer, a laser facsimile, an electrostatic recorder and the like, in addition to an electrophotographic copying machine.

Also, the biasing means for biasing the contact-to-charge means toward the image carrier is not limited to the coil spring but can be any suitable means which can exert a resilient biasing force to the contact-to-charge means.

Similarly, the image carrier may include various kinds of image carriers capable of forming an electrostatic latent image by charging the surface, such as an electrostatic recording dielectric, in addition to the photosensitive drum. The carrier cleaning means is not limited to the blade-like cleaning member either but it may be a brush-like cleaning member, for example. Likewise, the contact-to-charge means is not necessarily be the charge roller but it may be a blade-like or brush-like charge member. Furthermore, the end portions of the follower elements illustrated in the first embodiment may be formed by a single or at least three inclination surfaces.

What is claimed is:

1. An image formation apparatus comprising:

an image carrier which is rotationally driven within a body of the apparatus;

contact-to-charge means which is brought into contact with a surface of said image carrier to charge the surface;

developing means for visualizing an electrostatic latent image formed on the surface of said image carrier;

transfer means for transferring a visible image formed on the surface of said image carrier to a transfer medium; and carrier cleaning means for cleaning the surface of said image carrier by being brought into contact with the surface;

at least said image carrier and contact-to-charge means being attached to a unit case so that said image carrier and contact-to-charge means can be freely attached to and detached from said apparatus body in unison with said unit case, said contact-to-charge means being able to be brought into and out of contact with the surface of said image carrier, said contact-to-charge means being spaced away from said image carrier when said unit case is attached to said apparatus body.

2. An image formation apparatus as defined in claim 1, further comprising biasing means mounted on said unit case and adapted to normally resiliently bias said contact-to-charge means in a contacting direction with said image carrier.

3. An image formation apparatus as defined in claims 1 or 2, further comprising contact-to-charge contacting/separating means for causing said contact-to-charge means to be brought into and out of contact with the surface of said image carrier.

4. An image formation apparatus as defined in claim 3, wherein said contacting/separating means causes said contact-to-charge means to be spaced away from said image carrier at least when said unit case is attached to said apparatus body and also causes said contact-to-charge means to be brought into contact, under a biasing force of said biasing means, with said image carrier after said image carrier, which has started rotation, is rotated exceeding an angle formed between adjacent normals passing across the areas where said carrier cleaning means and contact-to-charge means contact said image carrier.

5. An image formation apparatus as defined in claim 3, wherein said contacting/separating means causes said contact-to-charge means to be spaced away from the surface of said image carrier at least during the time said image carrier is stopped in rotation.

6. An image formation apparatus as defined in claim 5, wherein said unit case includes charge cleaning means for cleaning said contact-to-charge means, said contact-to-charge means being cleaned by being brought into contact with said charge cleaning means when said contact-to-charge means is spaced away from said image carrier.

7. An image formation apparatus comprising:

an image carrier which is rotationally driven within a body of the apparatus;

contact-to-charge means which is brought into contact with a surface of said image carrier to charge the surface;

developing means for visualizing an electrostatic latent image formed on the surface of said image carrier;

transfer means for transferring a visible image formed on the surface of said image carrier to a transfer medium; and carrier cleaning means for cleaning the surface of said image carrier by being brought into contact with the surface;

at least said image carrier and contact-to-charge means being attached to a unit case so that said image carrier and contact-to-charge means can be freely attached to and detached from said apparatus body in unison with said unit case, said contact-to-charge means being able to be brought into and out of contact with the surface of said image carrier;

wherein said apparatus body includes a rotational driving shaft for rotationally driving said image carrier, and a drive transmission pin extending radially from said rotational driving shaft, and wherein said image carrier includes a sleeve-like coupling portion formed on one end of said image carrier, a plurality of follower elements extending radially from an inner wall of said coupling portion at a predetermined angle, and an insertion portion formed between said follower elements and adapted to allow insertion of said drive transmission pin, an end portion on the side of an opening portion of said coupling portion in said follower elements being formed by a single or a plurality of inclination surfaces inclining toward the insertion portion side of said drive transmission pin, a maximum relative angle of rotation formed between said follower elements and said drive transmission pin when said drive transmission pin is brought into contact with said inclination surfaces and received in said insertion portion, being set smaller than the angle formed between the adjacent normals passing across the areas where said carrier cleaning means and contact-to-charge means contact said image carrier.

8. An image formation apparatus as defined in claim 7, wherein a ridge line at a crest portion of said inclination surfaces forming the end portion of said follower elements is situated in an imaginary plane which is generally perpendicular to the insertion direction of said drive transmission pin.

9. An image formation apparatus as defined in claim 7, wherein said contact-to-contact means is automatically spaced away from said image carrier when said unit case is attached to said apparatus body.

10. An image forming apparatus comprising:

an image carrier which is rotationally driven within a body of the apparatus;

contact-to-charge means which is brought into contact with a surface of said image carrier to charge the surface;

developing means for visualizing an electrostatic latent image formed on the surface of said image carrier;

transfer means for transferring a visible image formed on the surface of said image carrier to a transfer medium; and carrier cleaning means for cleaning the surface of said image carrier by being brought into contact with the surface;

at least said image carrier, said contact-to-charge means, and charge cleaning means being attached to a unit case so that said image carrier, said contact-to-charge means, and said charge cleaning means can be freely attached to and detached from said apparatus body in unison with said unit case, said contact-to-charge means being able to be brought into and out of contact with the surface of said image carrier, said contact-to-charge means being cleaned by being brought into contact with said charge cleaning means when said contact-to-charge means is spaced away from said image carrier.

11. An image formation apparatus as defined in claim 10, wherein said unit case including drive transmission means for, when said contact-to-charge means is spaced away from said image carrier, rotationally driving said contact-to-charge means for cleaning.

* * * * *